US009236204B2

(12) United States Patent
Hsu et al.

(10) Patent No.: US 9,236,204 B2
(45) Date of Patent: Jan. 12, 2016

(54) KEYSWITCH WITH MAGNETIC RESTORATION MECHANISM

(71) Applicants: DARFON ELECTRONICS (SUZHOU) CO., LTD., Suzhou, Jiangsu Province (CN); DARFON ELECTRONICS CORP., Taoyuan (TW)

(72) Inventors: Chien-Shih Hsu, Taoyuan (TW); Zuei-Chown Jou, Taoyuan (TW)

(73) Assignees: DARFON ELECTRONICS (SUZHOU) CO., LTD., New District, Suzhou, Jiangsu Province (CN); DARFON ELECTRONICS CORP., Gueishan, Taoyuan (TW)

( * ) Notice: Subject to any disclaimer, the term of this patent is extended or adjusted under 35 U.S.C. 154(b) by 18 days.

(21) Appl. No.: 14/472,382

(22) Filed: Aug. 29, 2014

(65) Prior Publication Data

US 2015/0083562 A1 Mar. 26, 2015

(30) Foreign Application Priority Data

Sep. 26, 2013 (TW) ..... 102134800 A

(51) Int. Cl.
*H01H 13/70* (2006.01)
*H01H 13/14* (2006.01)
*H01H 13/10* (2006.01)

(52) U.S. Cl.
CPC ..... *H01H 13/14* (2013.01); *H01H 13/10* (2013.01); *H01H 2221/04* (2013.01); *H01H 2221/058* (2013.01); *H01H 2227/036* (2013.01)

(58) Field of Classification Search
CPC ..... H01H 13/00; H01H 13/02; H01H 13/14; H01H 13/20; H01H 13/52; H01H 9/00
USPC ..... 200/344; 400/495
See application file for complete search history.

(56) References Cited

U.S. PATENT DOCUMENTS

| | | | | |
|---|---|---|---|---|
| 6,455,794 | B2 * | 9/2002 | Sato | H01H 3/122 200/344 |
| 9,064,651 | B2 * | 6/2015 | Hsu | H01H 13/02 |
| 9,099,261 | B2 * | 8/2015 | Hsu | H01H 13/7065 |
| 2014/0231234 | A1 * | 8/2014 | Hsu | H01H 13/52 |
| 2014/0367236 | A1 * | 12/2014 | Chiang | H01H 13/705 200/344 |
| 2015/0243456 | A1 * | 8/2015 | Hsu | H01H 13/20 200/344 |

FOREIGN PATENT DOCUMENTS

| | | |
|---|---|---|
| JP | 2008251461 | 10/2008 |
| TW | 577626 | 2/2004 |
| TW | 200620356 | 6/2006 |
| TW | M386584 | 8/2010 |
| TW | M388083 | 9/2010 |
| TW | 201243892 | 11/2012 |
| TW | 201322293 | 6/2013 |

* cited by examiner

*Primary Examiner* — Vanessa Girardi
(74) *Attorney, Agent, or Firm* — Winston Hsu; Scott Margo

(57) ABSTRACT

A keyswitch structure includes a base, a keycap, at least one lift mechanism, a link, and a restoration mechanism. The lift mechanism is connected to and between the base and the keycap. The link is moveably on the base. The restoration mechanism is disposed on the link and the base and can generate a restoration force. When the keycap is pressed down by a user to move toward the base, a sliding portion of the lift mechanism slides on the base to drive the link to move relative to the base. Further, when the pressing on the keycap by the user is eliminated, the restoration force urges the link to move to drive the sliding portion to slide reversely, so that the keycap moves away from the base.

22 Claims, 20 Drawing Sheets

KEYSWITCH WITH MAGNETIC RESTORATION MECHANISM

BACKGROUND OF THE INVENTION

1. Field of the Invention

The invention relates to a low-profile keyswitch structure, and especially relates to a multiple-width keyswitch structure.

2. Description of the Prior Art

Please refer to FIG. 20, which is a schematic diagram illustrating a keyswitch 9 shown by FIG. 1 in U.S. Pat. No. 6,056,459. The path length of an up and down movement of the keyswitch 9 is long, so a cupped rubber 94 (rubber actuator) is disposed under the keycap 92 so that when pressure on the keycap 92 is eliminated, a resilient force produced by the cupped rubber 94 returns the keycap 92 upward to its original position. However, with on-going miniaturization of keyboards, the heights of the keyswitch and of the cupped rubber 94 need to decrease correspondingly. However, properties of the cupped rubber 94 such as service life and elasticity become worse as the height of the cupped rubber 94 decreases.

In addition, a wider keyswitch like the keyswitch 9 is also called a multiple-width keyswitch. In a multiple-width keyswitch, a plurality of links 96 and 98 (wire members) are disposed under the keycap 92, so that when a user presses any position of the keycap 92, the entire keycap 92 moves up and down relative to the base so that the user can feel a distinct resilient force (tactile feedback). However, as the height of the keyboard decreases, such configuration is not easy due to space constraint.

SUMMARY OF THE INVENTION

An objective of the invention is to provide a keyswitch structure. The keyswitch structure uses a restoration mechanism capable of generating a restoration force so that its keycap is capable of moving smoothly for providing a distinct feeling a key press.

In an embodiment, a keyswitch structure of the invention includes a base, a keycap, a lift mechanism, and a link. The base includes a first magnetic portion. The keycap is disposed above the base. The lift mechanism is connected to and between the base and the keycap. The lift mechanism includes a first supporting part and a second supporting part. The lift mechanism and the keycap are connected by a connection portion. The first supporting part has a sliding portion slidably disposed on the base. The keycap is capable of moving up and down relative to the base through the first lift mechanism. The link is moveably disposed on the base. The link has a second magnetic portion. The second magnetic portion and the first magnetic portion generate a magnetic force therebetween. In logic, the first magnetic portion and the second magnetic portion can be regarded as a restoration mechanism disposed on the link and the base; the magnetic force is a restoration force generated by the restoration mechanism. Therein, when the keycap is pressed by a user so that the keycap moves toward the base through the first lift mechanism, the first sliding portion slides on the base in a sliding direction and drives the link to move relative to the base. When the pressing on the keycap by the user is eliminated, the magnetic force urges the link to move to drive the first sliding portion to slide in a direction opposite to the sliding direction so that the keycap moves away from the base.

In another embodiment, a keyswitch structure of the invention includes a base, a keycap, a first lift mechanism, a second lift mechanism, a link, and a restoration mechanism. The keycap is disposed above the base. The first lift mechanism is connected to and between the base and the keycap. The first lift mechanism includes a first supporting part. The first supporting part has a first sliding portion. The first sliding portion is slidably disposed on the base. The link has a first end portion and a second end portion. The first end portion is connected to the first sliding portion. The second lift mechanism is connected to and between the base and the keycap. The second lift mechanism includes a third supporting part. The third supporting part has a second sliding portion. The second sliding portion is slidably disposed on the base and connected to the second end portion of the link. The keycap is capable of moving up and down relative to the base through the first lift mechanism or the second lift mechanism. The restoration mechanism is used for generating a restoration force. The restoration mechanism is disposed on the link and the base. In practice, the restoration mechanism can include an elastic part, connected to the link and the base. The elastic part is capable of elastically deforming to generate the restoration force. Therein, when the keycap moves toward the base through the first lift mechanism or the second lift mechanism, the first sliding portion and the second sliding portion slide on the base in a sliding direction and drive the link to move relative to the base. The restoration force urges the link to move to drive the first sliding portion and the second sliding portion to slide in a direction opposite to the sliding direction so that the keycap moves away from the base.

Compared with the prior art, the keyswitch structure of the invention use the restoration mechanism to generate a restoration force (e.g. a magnetic force or a resilient force). Furthermore, the keycap moves vertically while the restoration mechanism moves horizontally, so the height of the keyswitch structure is less affected by the moving of the restoration mechanism. Furthermore, the keyswitch structure of the invention uses the link by which the restoration mechanism is kinetically connected to the lift mechanisms simultaneously. In other words, the restoration force drives the lift mechanisms simultaneously through the link, which is conducive to improvement in the movement stability of the keycap and offers the user distinct feeling of a key press. In addition, when the magnetic force is a magnetically attractive force, the magnetic force decreases as the keycap moves toward the base, so that the force feedback by the magnetic force through the life mechanism and the keycap to a finger of the user is more close to a force feedback provided by a conventional keyswitch structure with relatively large structure configuration. Therefore, the keyswitch structure of the invention can offer the user more distinct feeling of a key press.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
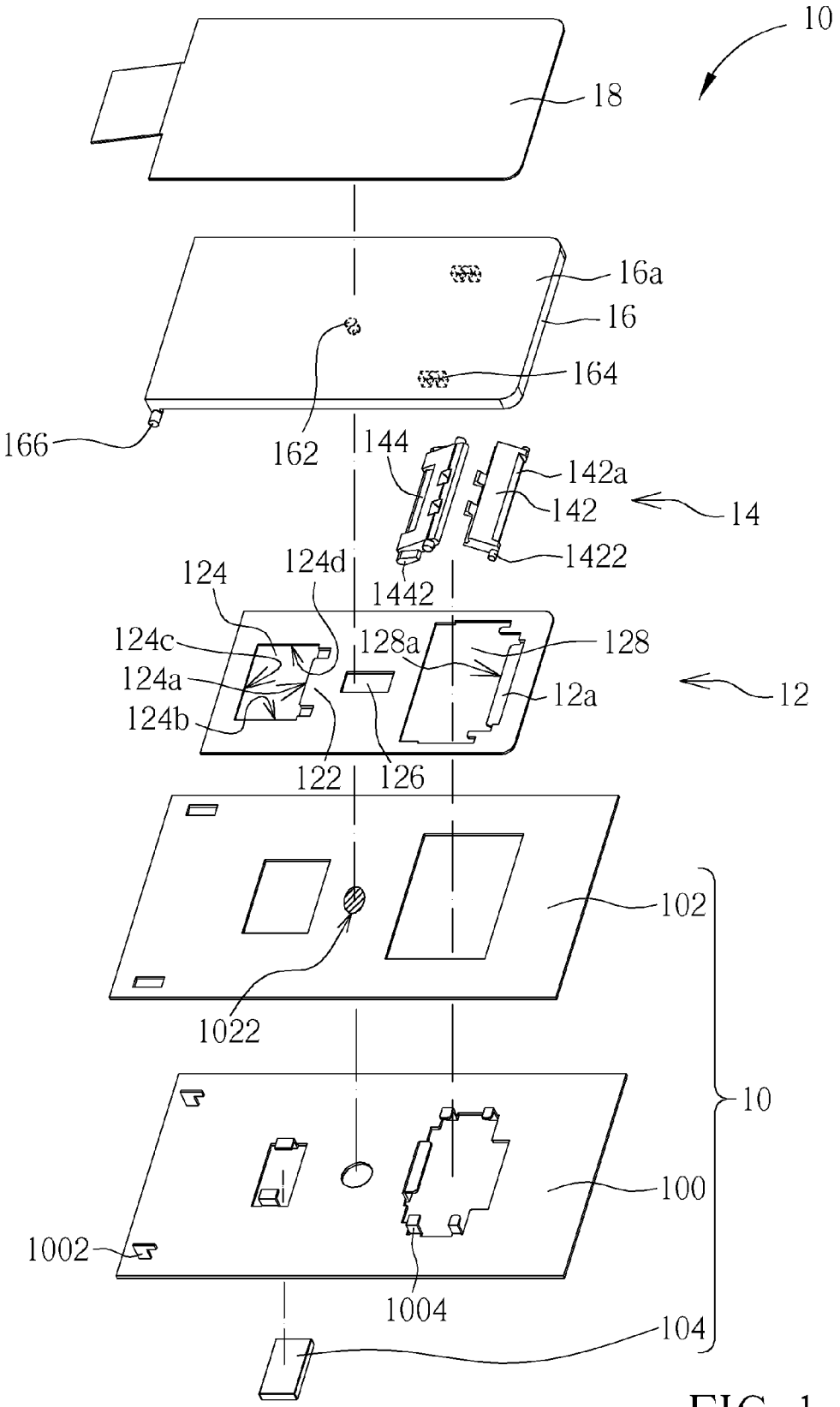
FIG. 1 is an exploded view of a keyswitch structure of a preferred embodiment according to the invention.
Figure 2:
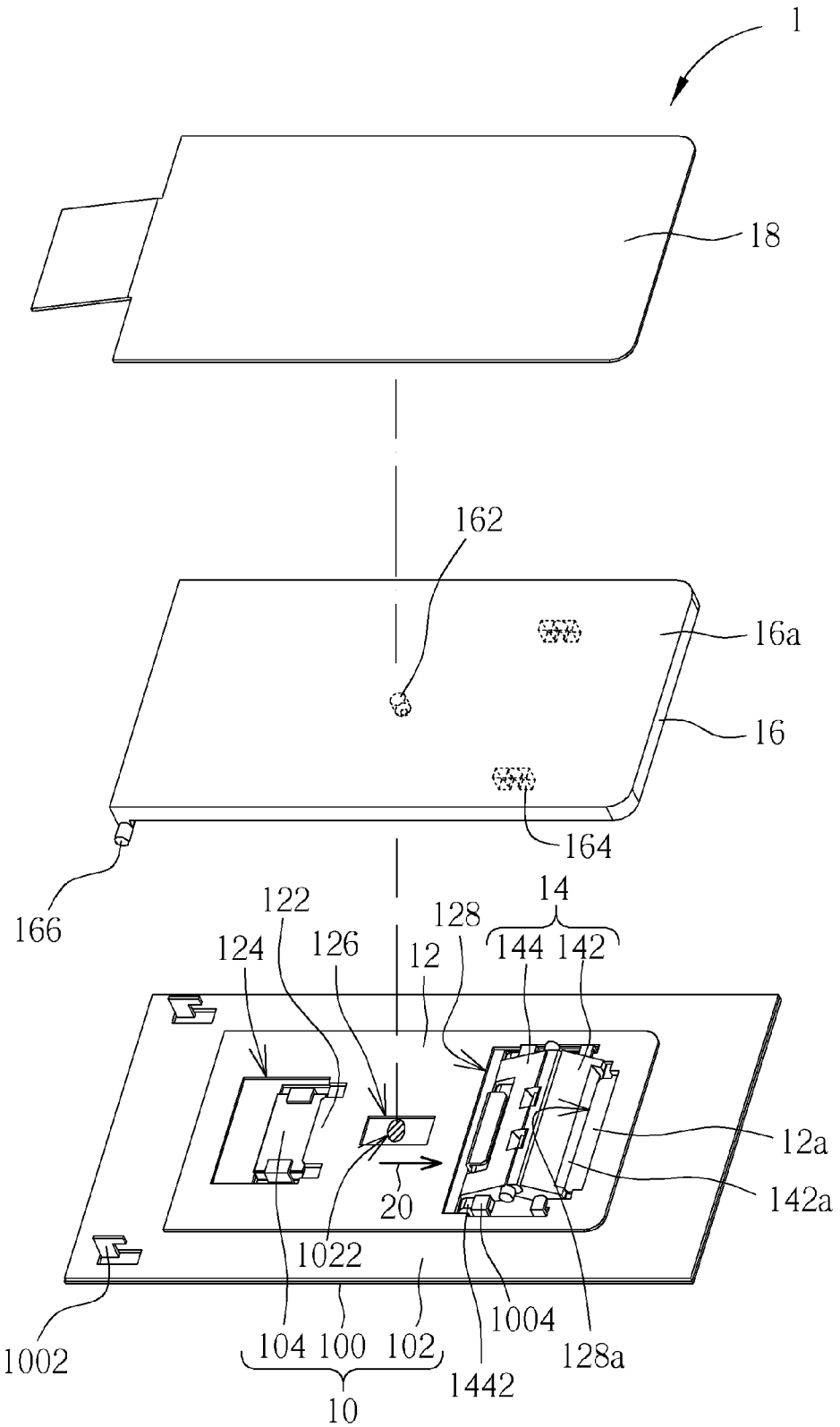
FIG. 2 is a partially exploded view of the keyswitch structure in FIG. 1.
Figure 3:
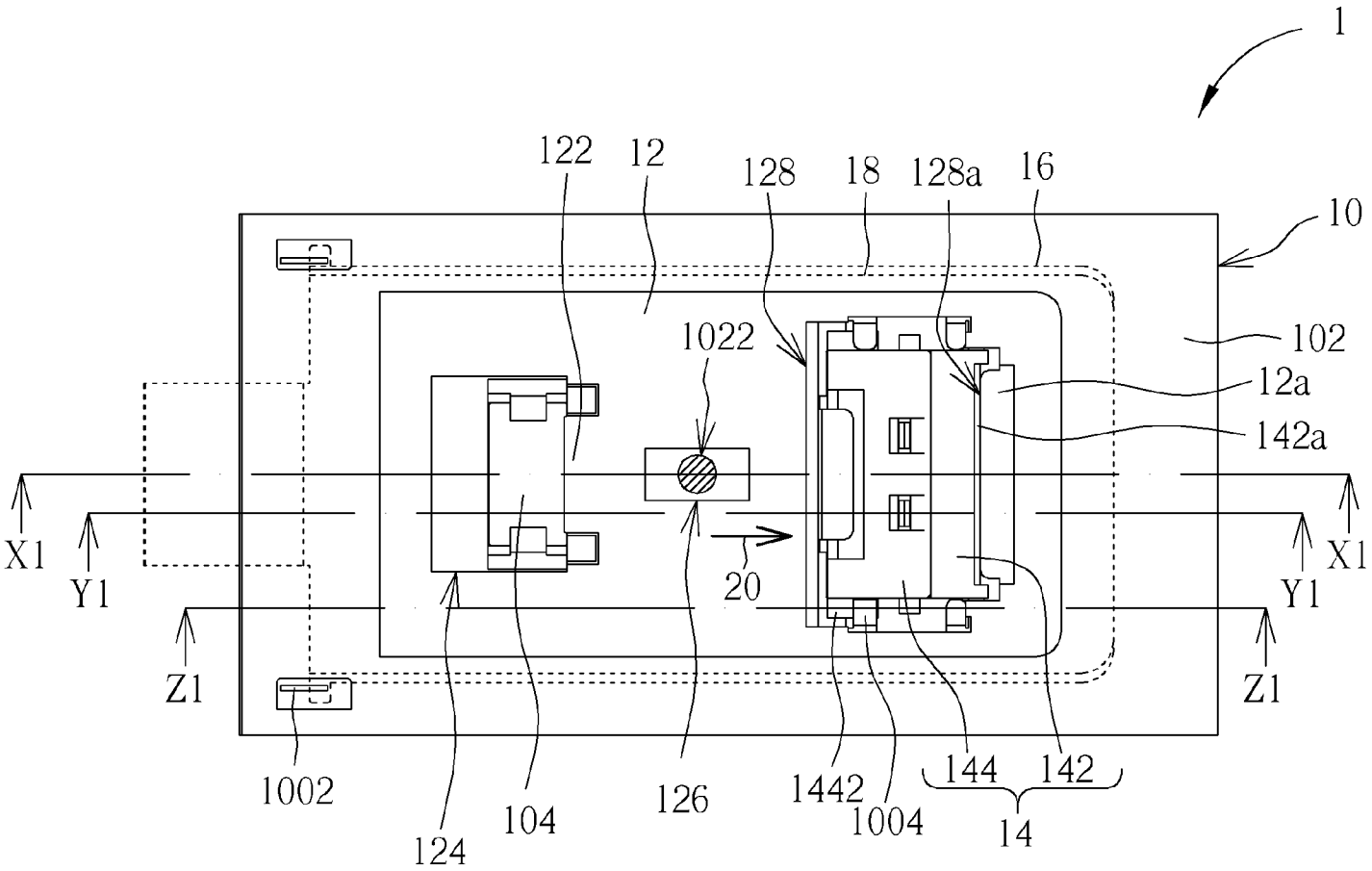
FIG. 3 is a top view of the keyswitch structure in FIG. 1.
Figure 4:
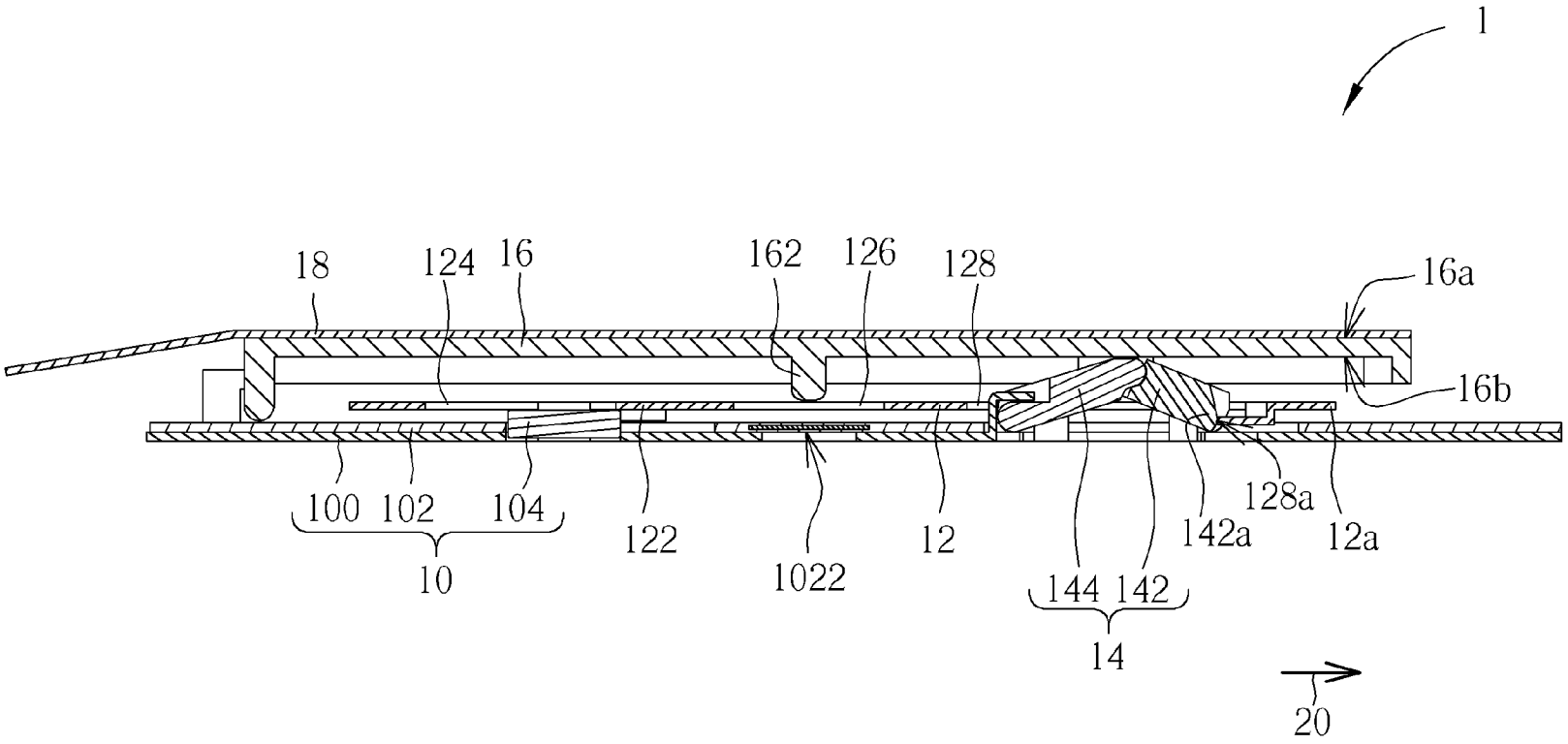
FIG. 4 is a sectional view of the keyswitch structure in FIG. 3 along the line X1-X1.
Figure 5:
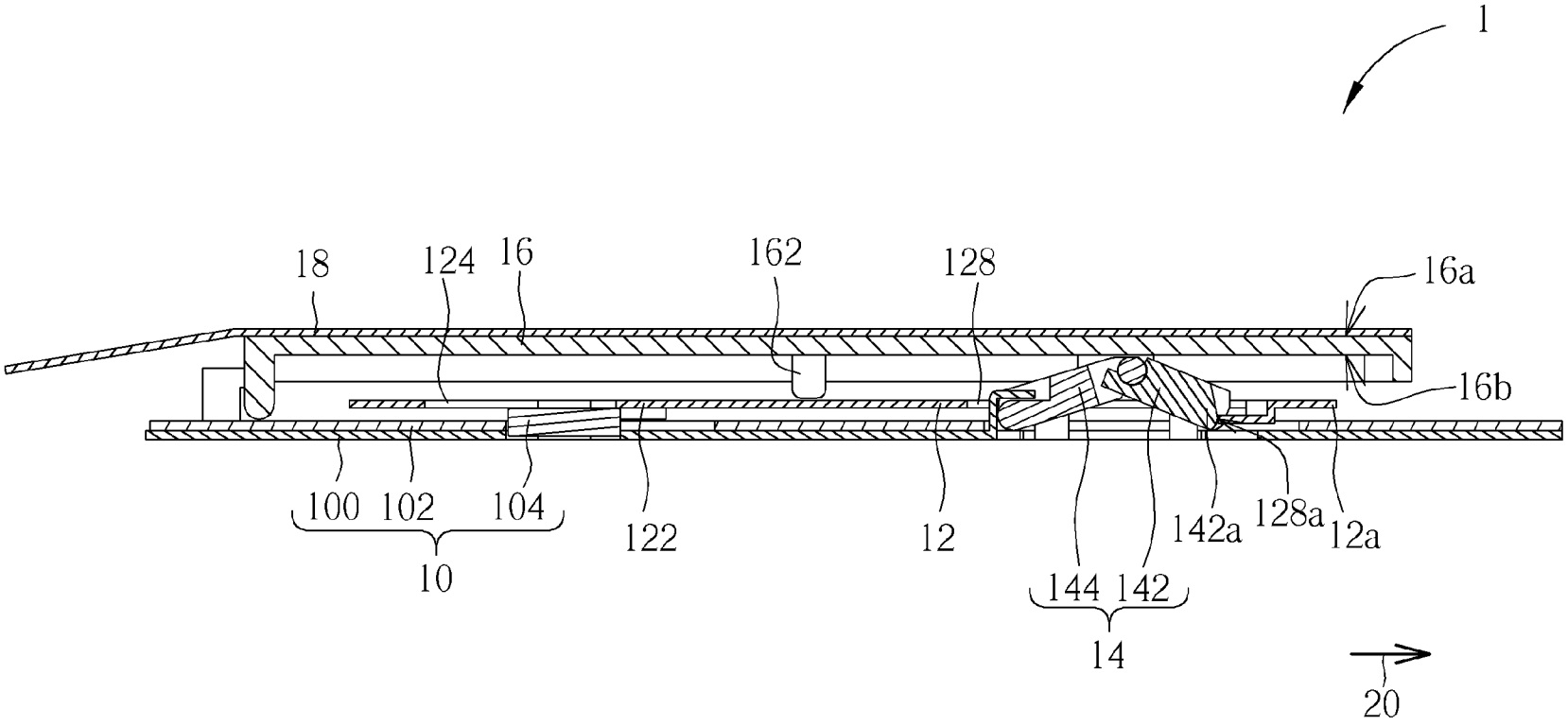
FIG. 5 is another sectional view of the keyswitch structure in FIG. 3 along the line Y1-Y1.
Figure 6:
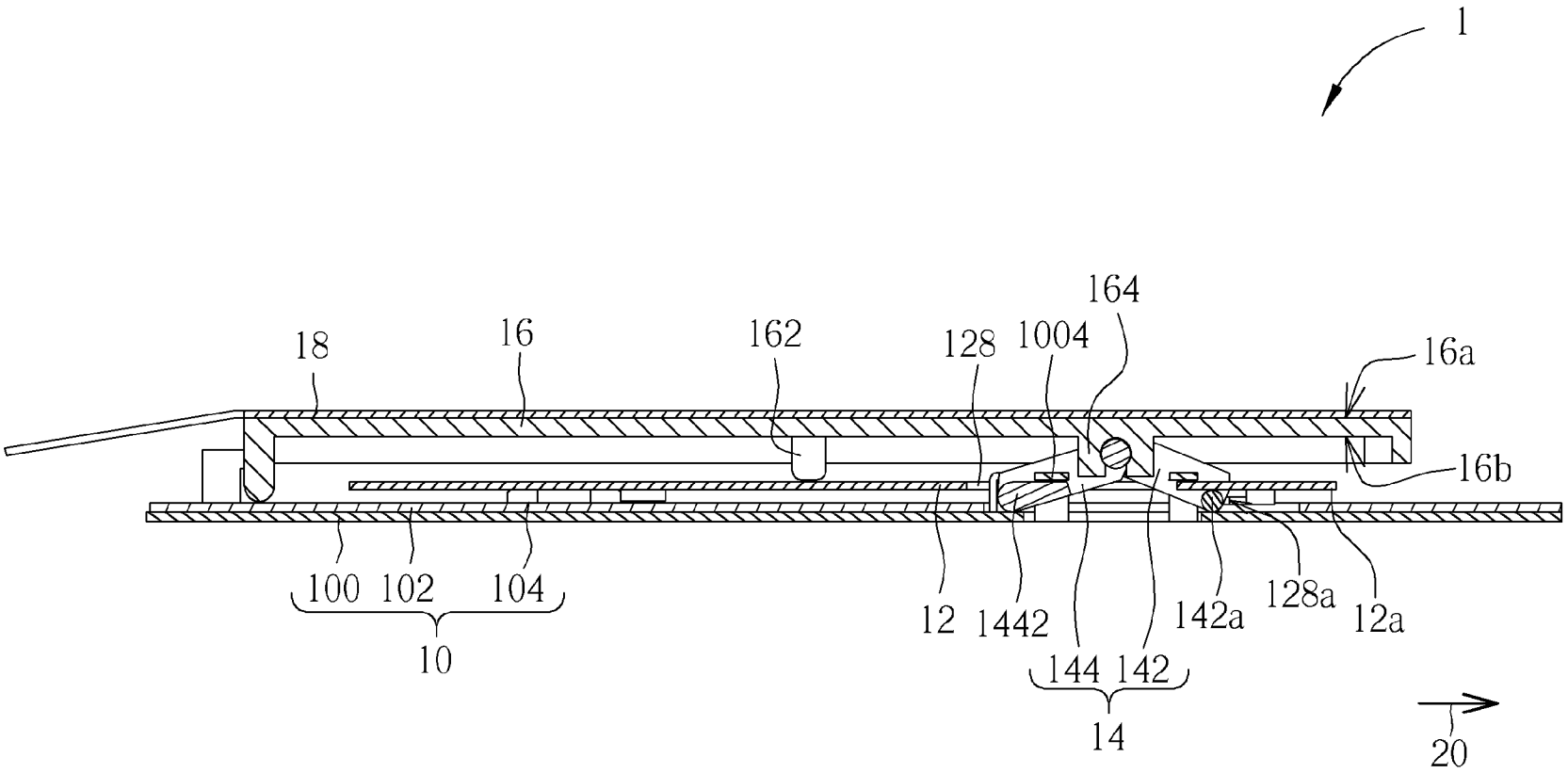
FIG. 6 is another sectional view of the keyswitch structure in FIG. 3 along the line Z1-Z1.
Figure 7:
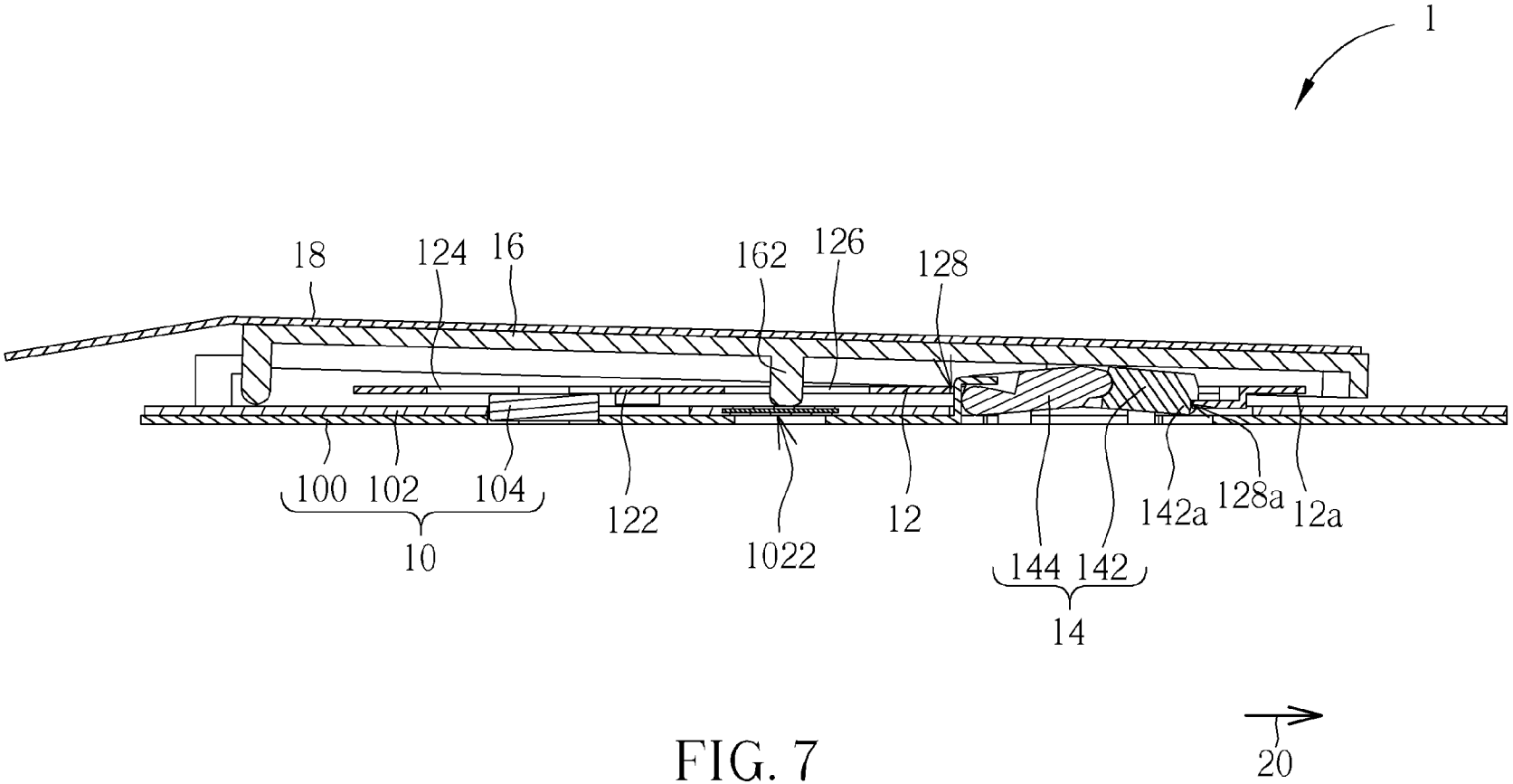
FIG. 7 is another sectional view of the keyswitch structure in FIG. 3 along the line X1-X1 with being pressed down.

Please refer to FIGS. 1 through 7. FIG. 1 is an exploded view of a keyswitch structure 1 of a preferred embodiment according to the invention. FIG. 2 is a partially exploded view of the keyswitch structure 1. FIG. 3 is a top view of the keyswitch structure 1. FIG. 4 is a sectional view of the keyswitch structure 1 along the line X1-X1 in FIG. 3. FIG. 5 is another sectional view of the keyswitch structure 1 along the line Y1-Y1 in FIG. 3. FIG. 6 is another sectional view of the keyswitch structure 1 along the line Z1-Z1 in FIG. 3. FIG. 7 is another sectional view of the keyswitch structure 1 along the line X1-X1 in FIG. 3 with being pressed down. The keyswitch structure 1 includes a base 10, a link 12, a lift mechanism 14, a keycap 16, and a touch pad 18. Therein, in FIG. 3, for showing other components clearly, the keycap 16 and the touch pad 18 are shown by their profiles in dashed lines. The keycap 16 is disposed above the base 10. The lift mechanism 14 is connected to and between the base 10 and the keycap 16, so that the keycap 16 can be pressed to move up and down relative to the base 10 through the lift mechanism 14. The touch pad 18 is disposed on a top surface 16*a* of the keycap 16, so that the keyswitch structure 1 can also provide a touch function. The link 12 is moveably disposed on the base 10. The link 12 is kinetically connected to the lift mechanism 14 through a restoration mechanism so that the link 12 and the lift mechanism 14 can drive each other to move.

Further, the base 10 includes a plate 100, a membrane 102, and a first magnetic portion 104. The membrane 102 is disposed on the plate 100 and includes a switch 1022 (shown by a hatched block in FIG. 1). The first magnetic portion 104 is disposed on the plate 100. The keycap 16 has a protrusion 162 and a connection portion 164 on a bottom surface 16*b* thereof toward the base 10. The keycap 16 has a pivot 166 at a side thereof for connecting with a connection structure 1002 of the plate 100. The connection structure 1002 allows the pivot 166 to rotate and slide relative to the plate 100. The protrusion 162 extends from the bottom surface 16*b* of the keycap 16 toward the base 10 corresponding to the switch 1022. When the keycap 16 moves toward the base 10 through the lift mechanism 14, the protrusion 162 triggers the switch 1022.

The lift mechanism 14 is disposed adjacent to the protrusion 162 and includes a first supporting part 142 and a second supporting part 144. Each of the first supporting part 142 and the second supporting part 144 is connected to the keycap 16 and the plate 100. Therein, the first supporting part 142 has a sliding portion 142*a*. The sliding portion 142*a* is slidably disposed on the base 10. The lift mechanism 14 and the keycap 16 are connected by the connection portion 164. The plate 100 includes a constraining mechanism 1004. The second supporting part 144 has a constrained portion 1442. The constraining mechanism 1004 is capable of blocking the constrained portion 1442 so that a rotational angle of the second supporting part 144 relative to the base 10 is limited; that is, a maximum height of the keycap 16 is under control. In the embodiment, the connection portion 164 is presented in a C-shaped structure, so that the lift mechanism 14 is rotatably connected to the keycap 16 through the connection portion 164; however, the invention is not limited thereto. In addition, in the embodiment, the first supporting part 142 and the second supporting part 144 are pivotally connected in a reverse V-shaped configuration; however, the invention is not limited thereto.

The link 12 has a second magnetic portion 122. The second magnetic portion 122 and the first magnetic portion 104 generate a magnetic force therebetween. A distance from the second magnetic portion 122 to the first magnetic portion 104 varies as the link 12 moves relative to the base 10 and the magnitude of the magnetic force varies accordingly. The link 12 also has a slot 124, a through hole 126, and a window 128. The first magnetic portion 104 is located in the slot 124. The slot 124 extends parallel to a sliding direction 20, so that during the link 12 moving relative to the base 10, the structure of either the first magnetic portion 104 or the base 10 for fixing the first magnetic portion 104 does not interfere with the link 12. The second magnetic portion 122 is located at a side edge 124*a* of the slot 124 opposite to the sliding direction. The through hole 126 is disposed corresponding to the switch 1022, so that the protrusion 162 is capable of passing through the through hole 126 and triggering the switch 1022. The window 128 is used for the lift mechanism 14 and the plate 100 to be connected. Furthermore, the sliding portion 142*a* is capable of pushing against a side edge 128*a* of the window 128 so that the purpose of driving the link 12 to move relative to the base 10 is achieved. In the embodiment, under the magnetic force (i.e. a magnetically attractive force) generated by the first magnetic portion 104 and the second magnetic portion 122, the sliding portion 142*a* keeps touching the side edge 128*a*. Therefore, in logic, the sliding portion 142*a* can be regarded as being connected to an end portion 12*a* of the link 12. In practice, the sliding portion 142*a* also can be connected with the link 12 by another connection structure. In addition, in the embodiment, the link 12 and the plate 100 constrain a sliding shaft 1422 of the first supporting part 142 together; however, the invention is not limited thereto.

It is added that in the embodiment, the restoration mechanism of the keyswitch structure 1 is the first magnetic portion 104 and the second magnetic portion 122. The restoration force generated by the restoration mechanism is the magnetic force generated by the first magnetic portion 104 and the second magnetic portion 122 therebetween. Therein, the first magnetic portion 104 itself is not located in the slot 124, which can reduce probability of the link 12 interfering with the first magnetic portion 104; however, the invention is not limited thereto. Furthermore, in the embodiment, when the keycap 16 moves up to the highest position, the distance between the second magnetic portion 122 and the first magnetic portion 104 reaches a minimum value, and the second magnetic portion 122 partially covers and touches the first portion 104. In addition, in the embodiment, the first magnetic portion 104 is a magnet. The link 12 is a magnetic metal plate. The second magnetic portion 122 is formed by a magnetic metal plate; that is, a portion of the link 12 at the side edge 124*a* is taken directly as the second magnetic portion 122. During the first magnetic portion 104 and the second magnetic portion 122 moving relatively without the other side edges 124*b*-124*d* of the slot 124 touching the first magnetic portion 104. However, the invention is not limited thereto, for example, two magnets may be directly used. Furthermore, in practice, when two magnets are used, the magnetic force can be a repulsive force or an attractive force. In the embodiment, the magnetic force generated by the first magnetic portion 104 and the second magnetic portion 122 therebetween is a magnetically attractive force.

Please refer to FIG. 4 and FIG. 7. When a user presses the keycap 16 (or through the touch pad 18) so that the keycap 16 moves toward the base 10 through the lift mechanism 14, the sliding portion 142*a* slides on the base 10 in the sliding direction 20 to drive the link 12 to move relative to the base 10; that is, the link 12 moves in the sliding direction 20. The protrusion 162 passes through the through hole 126 and triggers the switch 1022, so that an function of keyswitch inputting is achieved. During the key press, the magnetic force generated by the first magnetic portion 104 and the second magnetic portion 122 therebetween decreases gradually. Then, when the key press on the keycap 16 by the user is eliminated, the magnetic force urges the link 12 to move in a direction opposite to the sliding direction 20 (i.e. moving reversely) to drive the sliding portion 142*a* to move in the direction opposite to the sliding direction 20 so that the keycap 16 moves away from the base 10. While the keycap 16 is moving away from the base 10 the magnetic force generated by the first magnetic portion 104 and the second magnetic portion 122 therebetween increases gradually. The magnetic force generated by the first magnetic portion 104 and the second magnetic portion 122 therebetween has an effect of restoring the keycap 16 automatically. Furthermore, the change of the magnetic force (i.e. the change of a force feedback) also can offer the user a distinct feeling of a key press. Especially when the keyswitch structure of the invention is applied to a low-profile keyboard, a problem can be avoided that it is difficult to verify whether a key press is completed or not due to an insufficient movement of the keycap 16.

Figure 8:
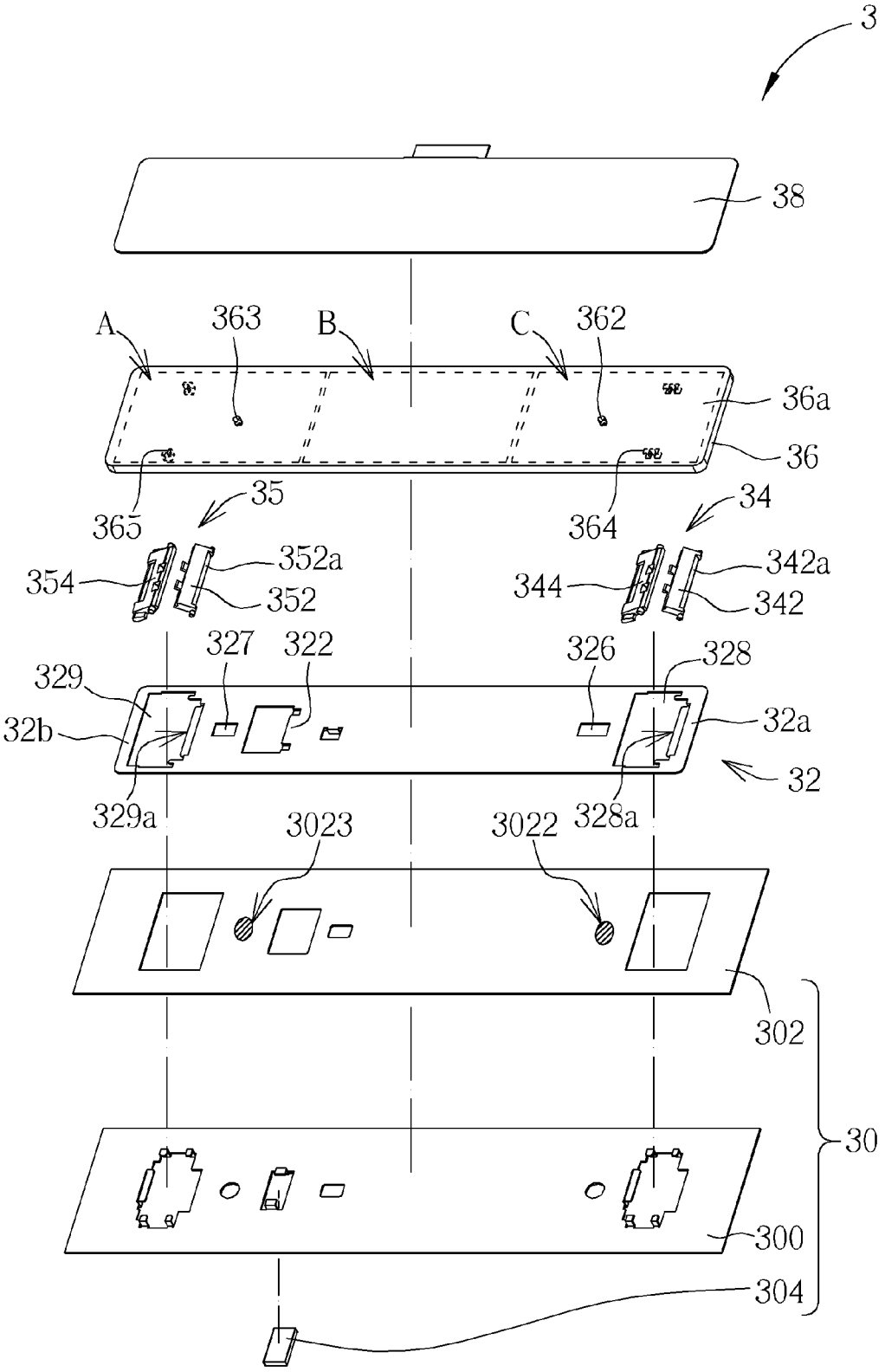
FIG. 8 is an exploded view of a keyswitch structure of another embodiment according to the invention.
Figure 9:
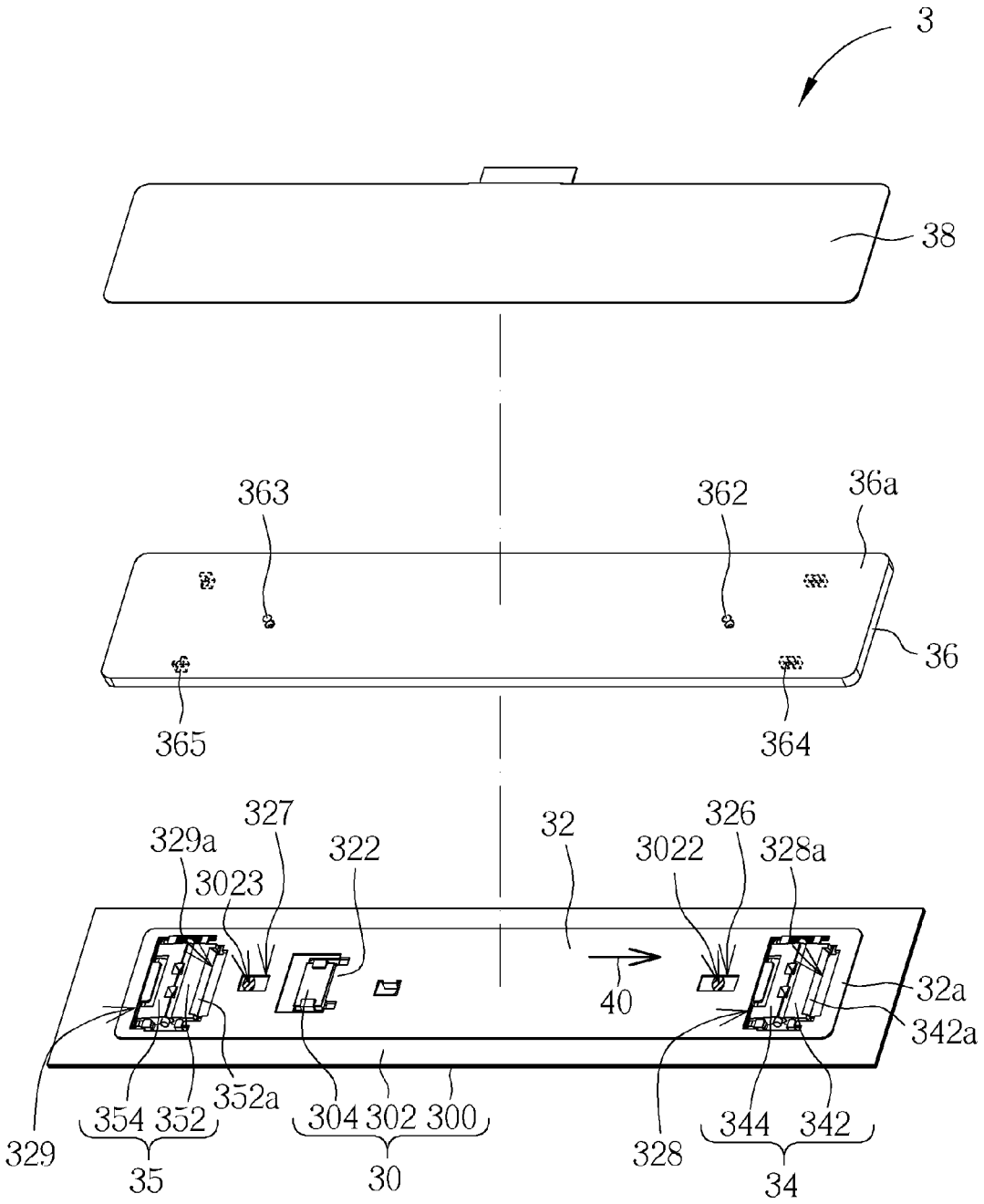
FIG. 9 is a partially exploded view of the keyswitch structure in FIG. 8.
Figure 10:
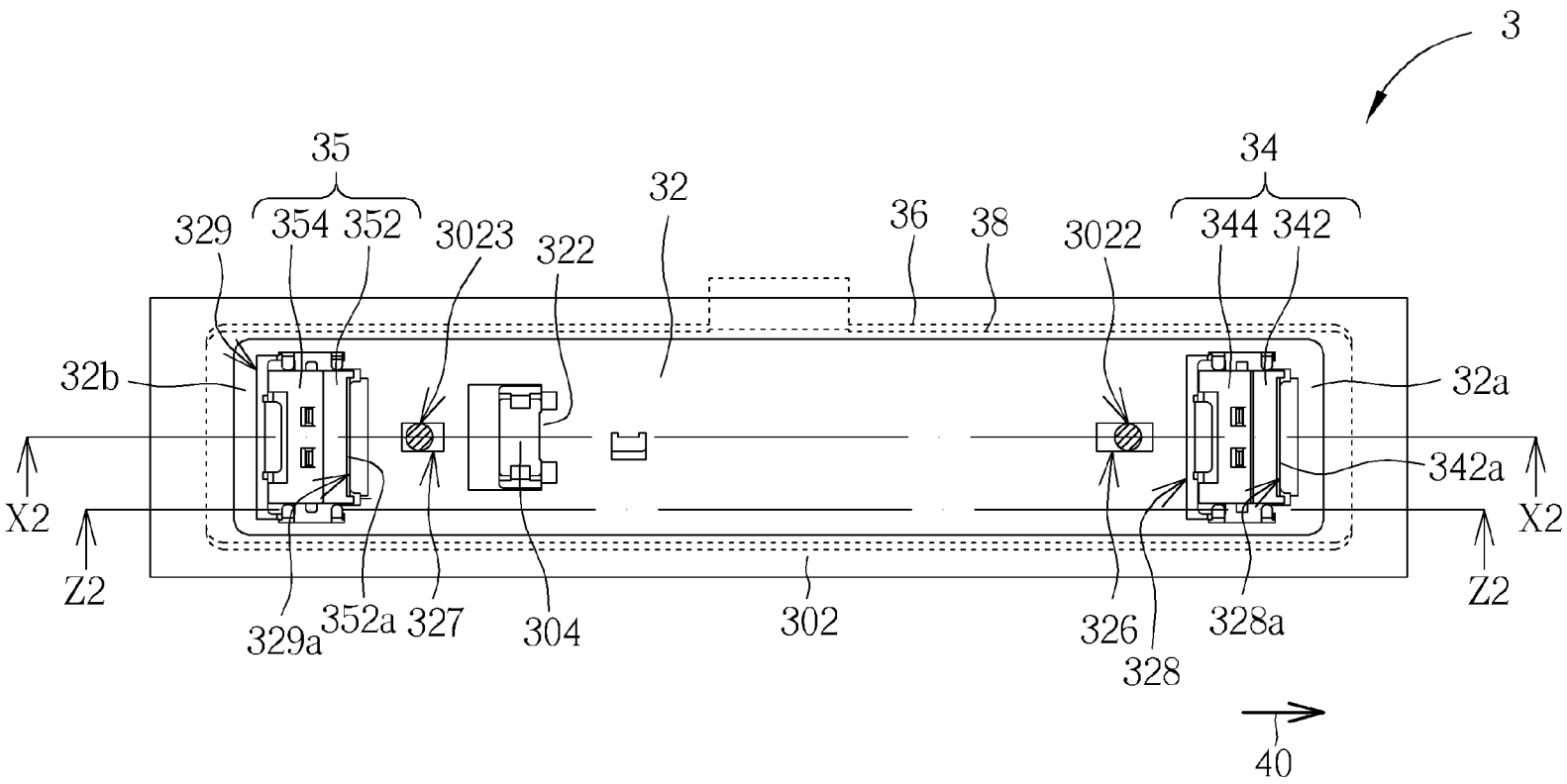
FIG. 10 is a top view of the keyswitch structure in FIG. 8.
Figure 11:
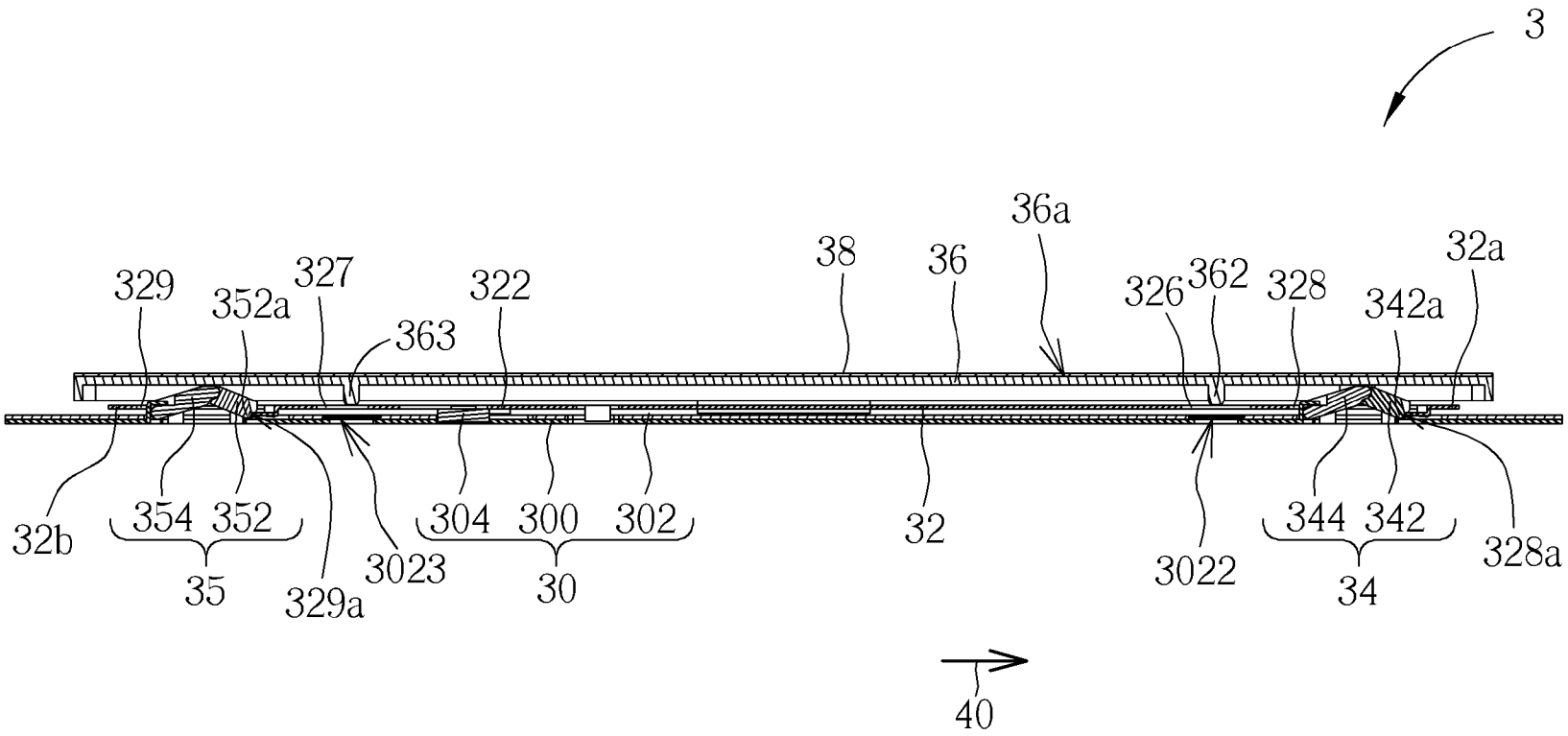
FIG. 11 is a sectional view of the keyswitch structure in FIG. 10 along the line X2-X2.
Figure 12:
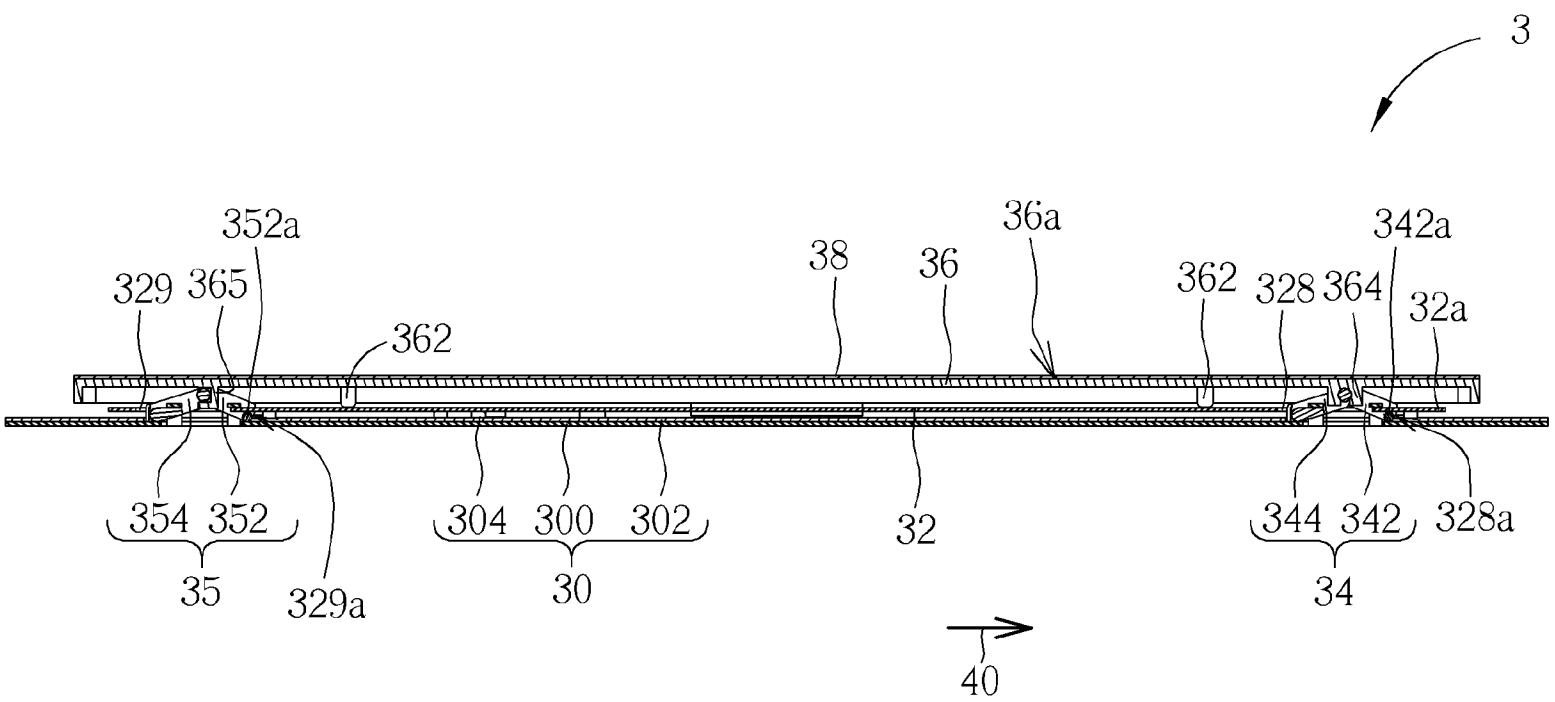
FIG. 12 is another sectional view of the keyswitch structure in FIG. 10 along the line Z2-Z2.
Figure 13:
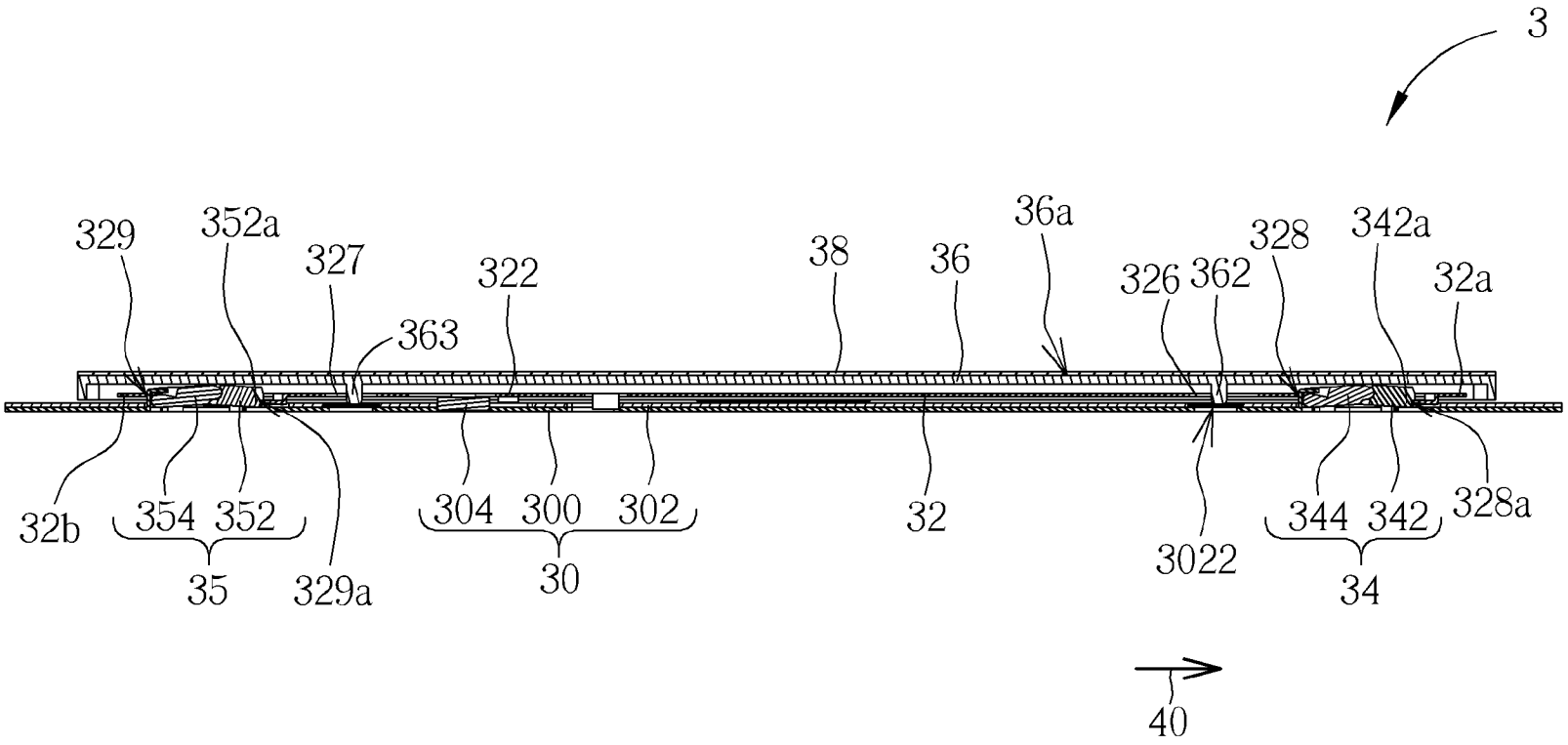
FIG. 13 is another sectional view of the keyswitch structure in FIG. 10 along the line X2-X2 with being pressed down.

Please refer to FIGS. 8 through 13. FIG. 8 is an exploded view of a keyswitch structure 3 of another embodiment according to the invention. FIG. 9 is a partially exploded view of the keyswitch structure 3. FIG. 10 is a top view of the keyswitch structure 3. FIG. 11 is a sectional view of the keyswitch structure 3 along the line X2-X2 in FIG. 10. FIG. 12 is another sectional view of the keyswitch structure 3 along the line Z2-Z2 in FIG. 10. FIG. 13 is another sectional view of the keyswitch structure 3 along the line X2-X2 in FIG. 10 with being pressed down. The keyswitch structure 3 includes abase 30, a link 32, a first lift mechanism 34, a second lift mechanism 35, a keycap 36, and a touch pad 38. In FIG. 10, for showing other components clearly, the keycap 36 and the touch pad 38 are shown by their profiles in dashed lines. The keycap 36 is disposed above the base 30. Each of the first lift mechanism 34 and the second lift mechanism 35 is connected to and between the base 30 and the keycap 36, so that the keycap 36 can be pressed to move up and down relative to the base 30 through the first lift mechanism 34 and the second lift mechanism 35. The touch pad 38 is disposed on a top surface 36*a* of the keycap 36, so that the keyswitch structure 3 can also provide a touch function. The link 32 is moveably disposed on the base 30. The link 32 is kinetically connected to the first lift mechanism 34 and the second lift mechanism 35 through a restoration mechanism, so that the link 32 can drive the first lift mechanism 34 and the second lift mechanism 35 to move. Compared with the keyswitch structure 1, the keyswitch structure 3 uses the same action mechanism as the keyswitch structure 1. A main difference between the keyswitch structure 3 and the keyswitch structure 1 is that the keyswitch structure 3 uses the two lift mechanisms 34 and 35. In practice, the keyswitch structure 3 can be applied to a wider keyswitch, for example a multiple-width key such as an enter key, a shift key, a space key, and so on. For other descriptions of the keyswitch structure 3, please refer to relevant descriptions of the components of the keyswitch structure 1 presented by the same notations, which will not be described repeatedly. In addition, the touch pad 38 can be used for performing a cursor function.

Briefly, the first lift mechanism 34 includes a first supporting part 342 and a second supporting part 344. The first supporting part 342 and the second supporting part 344 are pivotally connected in a reverse V-shaped configuration. The first supporting part 342 has a first sliding portion 342*a*. The first sliding portion 342*a* is slidably disposed on the base 30. The first lift mechanism 34 and the keycap 36 are connected by a first connection portion 364 of the keycap 36. In the embodiment, the first connection portion 364 is presented in a C-shaped structure, so that the first lift mechanism 34 is rotatably connected to the keycap 36 through the first connection portion 364. The first sliding portion 342*a* is capable of pushing against a side edge 328*a* of a window 328 of the link 32 so that the purpose of driving the link 32 to move relative to the base 30 is achieved. The second lift mechanism 35 includes a third supporting part 352 and a fourth supporting part 354. The third supporting part 352 and the fourth supporting part 354 are pivotally connected in a reverse V-shaped configuration. The third supporting part 352 has a second sliding portion 352*a*. The second sliding portion 352*a* is slidably disposed on the base 30. The second lift mechanism 35 and the keycap 36 are connected by a second connection portion 365 of the keycap 36. In the embodiment, the second connection portion 365 is presented in an L-shaped slot structure so that the second lift mechanism 35 is slidably connected to the keycap 36 through the second connection portion 364. The second sliding portion 352*a* is capable of pushing against a side edge 329*a* of a window 329 of the link 32 so that the purpose of driving the link 32 to move relative to the base 30 is achieved.

In the embodiment, the first lift mechanism 34 and the second lift mechanism 35 are provided in the same structure; however, the invention is not limited thereto. It is added that in the embodiment, the restoration mechanism of the keyswitch structure 3 also comprises a first magnetic portion 304, disposed on a plate 300 of the base 30, and a second magnetic portion 322, disposed on the link 32. The restoration force generated by the restoration mechanism is provided by a magnetic force generated by the first magnetic portion 304 and the second magnetic portion 322 therebetween. The first magnetic portion 304 and the second magnetic portion 322 are located between the first lift mechanism 34 and the second lift mechanism 35. Under the magnetic force (i.e. a magnetically attractive force) generated by the first magnetic portion 304 and the second magnetic portion 322, the first sliding portion 342*a* and the second sliding portion 352*a* keep touching the side edges 328*a* and 329*a* respectively. In logic, the first sliding portion 342*a* can be regarded as being connected to a first end portion 32*a* of the link 32. The second sliding portion 352*a* can be regarded as being connected to a second end portion 32*b* of the link 32. In practice, each of the first sliding portion 342*a* and the second sliding portion 352*a* also can be connected with the link 32 by another connection structure.

Therefore, when the user presses the keycap 36 (or through the touch pad 38) so that the keycap 36 moves toward the base 30 through the first lift mechanism 34 or the second lift mechanism 35, the first sliding portion 342*a* and the second sliding portion 352*a* slide on the base 30 in a sliding direction 40 to drive the link 32 to move relative to the base 30; that is, the link 32 moves in the sliding direction 40. Either of two protrusions 362 and 363 of the keycap 36 passes through a corresponding through hole 326 or 327 of the link 32 and triggers a corresponding switch 3022 or 3023 of a membrane 302 of the base 30, so that an function of keyswitch inputting is achieved.

During the key press, the magnetic force generated by the first magnetic portion 304 and the second magnetic portion 322 therebetween decreases gradually. Then, when the key press on the keycap 36 by the user is eliminated, the magnetic force urges the link 32 to move in a direction opposite to the sliding direction 40 (i.e. moving reversely) to drive the first sliding portion 342*a* and the second sliding portion 352*a* to move in the direction opposite to the sliding direction 40, so that the keycap 36 moves away from the base 30. While the keycap 36 is moving away from the base 30, the magnetic force generated by the first magnetic portion 304 and the second magnetic portion 322 therebetween increases gradually. The magnetic force generated by the first magnetic portion 304 and the second magnetic portion 322 therebetween has an effect of restoring the keycap 36 automatically. Furthermore, the change of the magnetic force (i.e. the change of a force feedback) also can offer the user a distinct feeling of a key press. Especially when the keyswitch structure of the invention is applied to a low-profile keyboard, a problem can be avoided that it is difficult to verify whether a key press is completed or not due to an insufficient movement of the keycap 36.

In addition, please refer to FIG. 8. The keycap 36 defines three blocks (presented by rectangles in dashed lines). When the user presses the block A of the keycap 36 (or through the touch pad 38), the second lift mechanism 35 moves toward the base 30 leading to a change of the magnetic force (i.e. a change of the force feedback), so that the user can feel that the first lift mechanism 34 does not move toward the base 30. Similarly, When the user presses the block C of the keycap 36, the first lift mechanism 34 moves toward the base 30 while the second lift mechanism 35 does not move toward the base 30. When the user presses the block B of the keycap 36 the first lift mechanism 34 and the second lift mechanism 35 moves toward the base 30 simultaneously.

Figure 14:
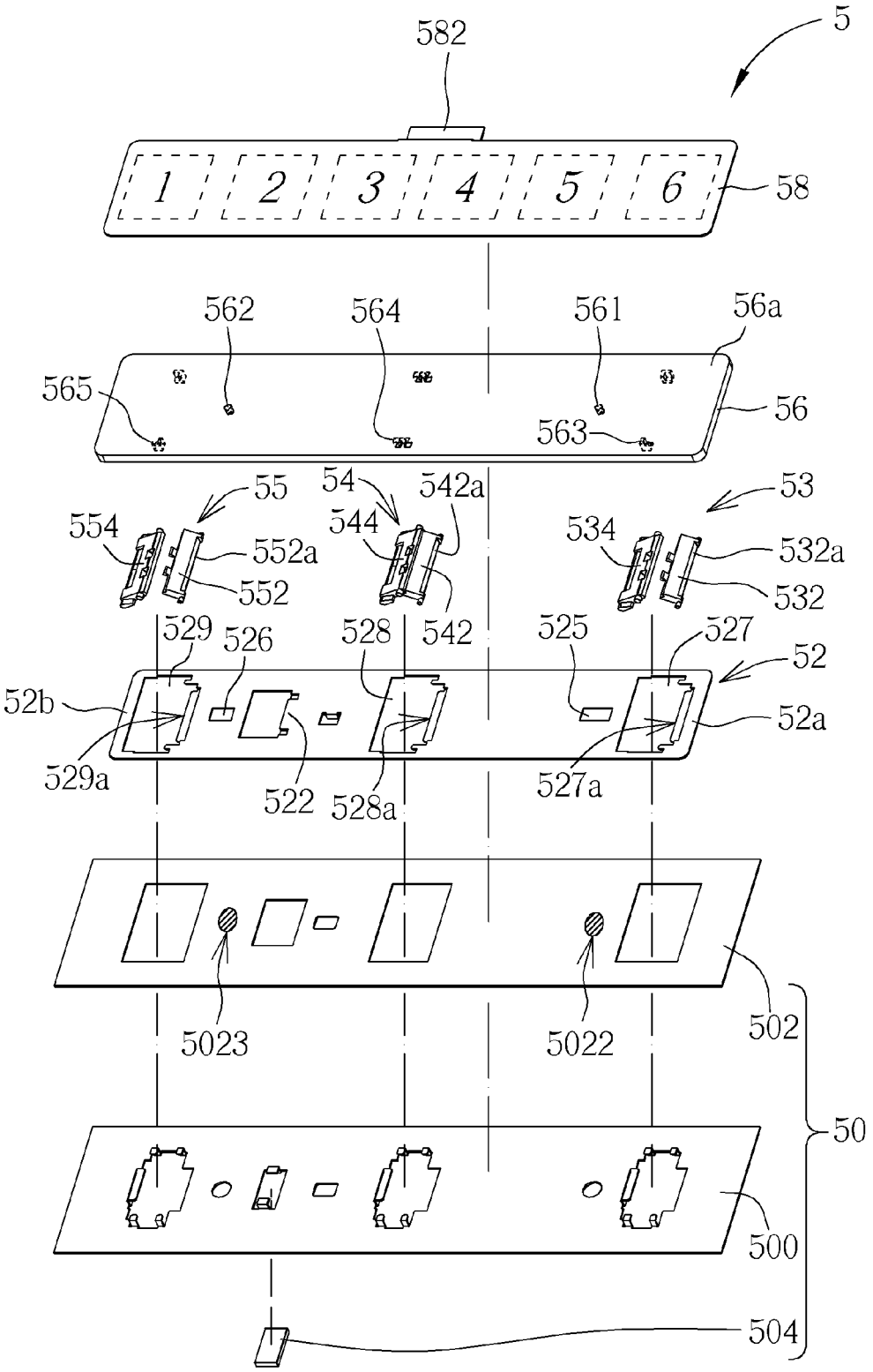
FIG. 14 is an exploded view of a keyswitch structure of another embodiment according to the invention.
Figure 15:
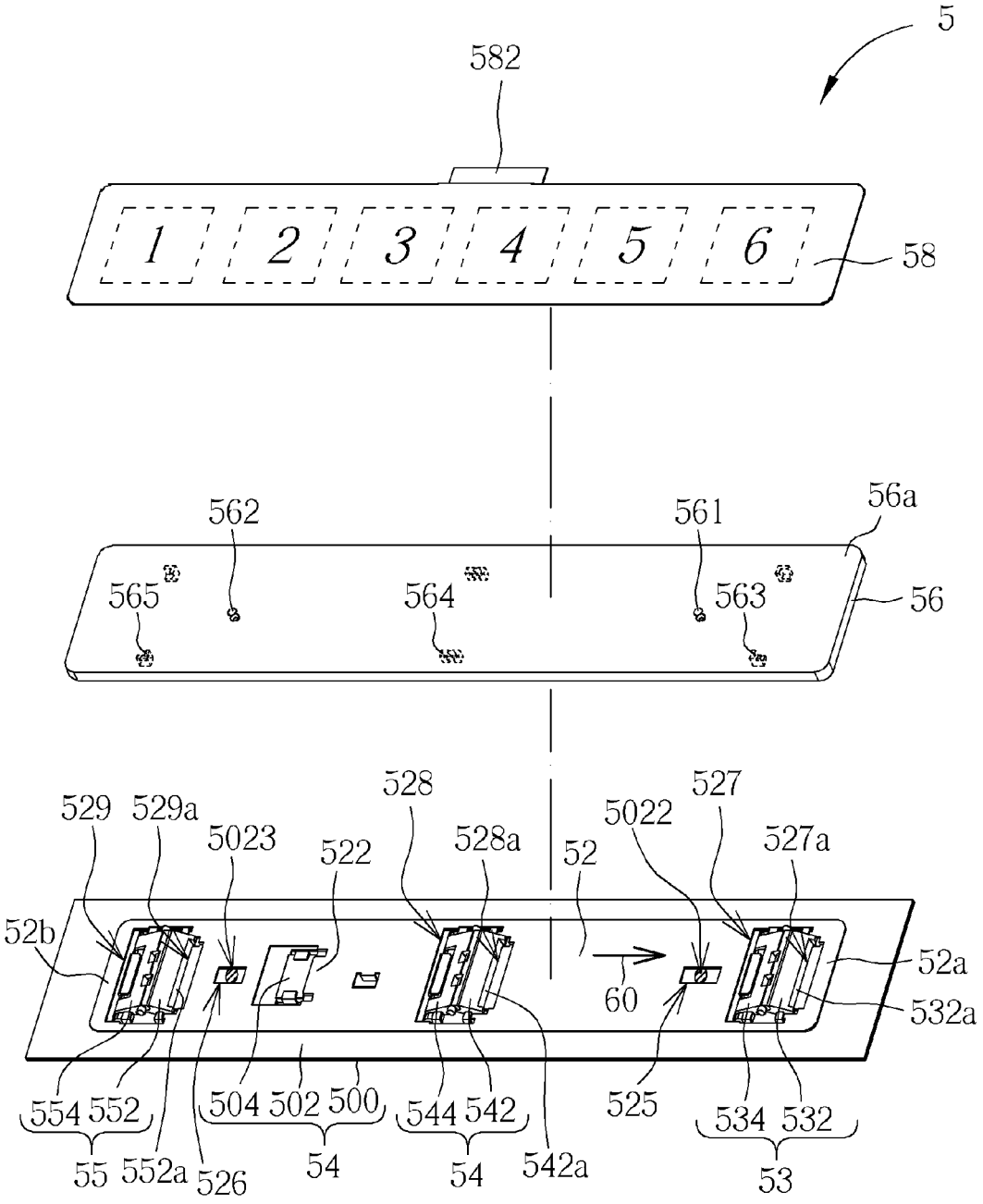
FIG. 15 is a partially exploded view of the keyswitch structure in FIG. 14.
Figure 16:
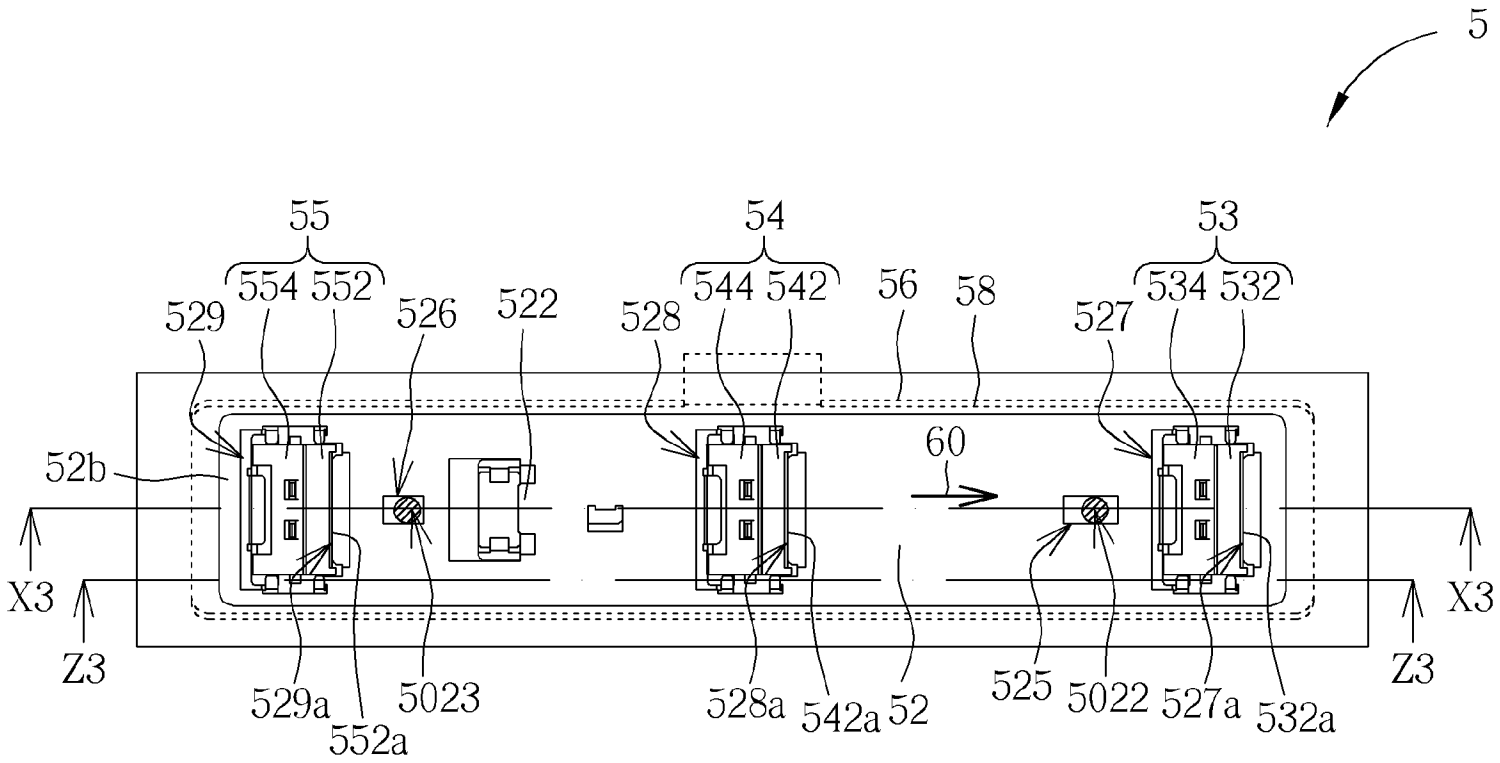
FIG. 16 is a top view of the keyswitch structure in FIG. 14.
Figure 17:
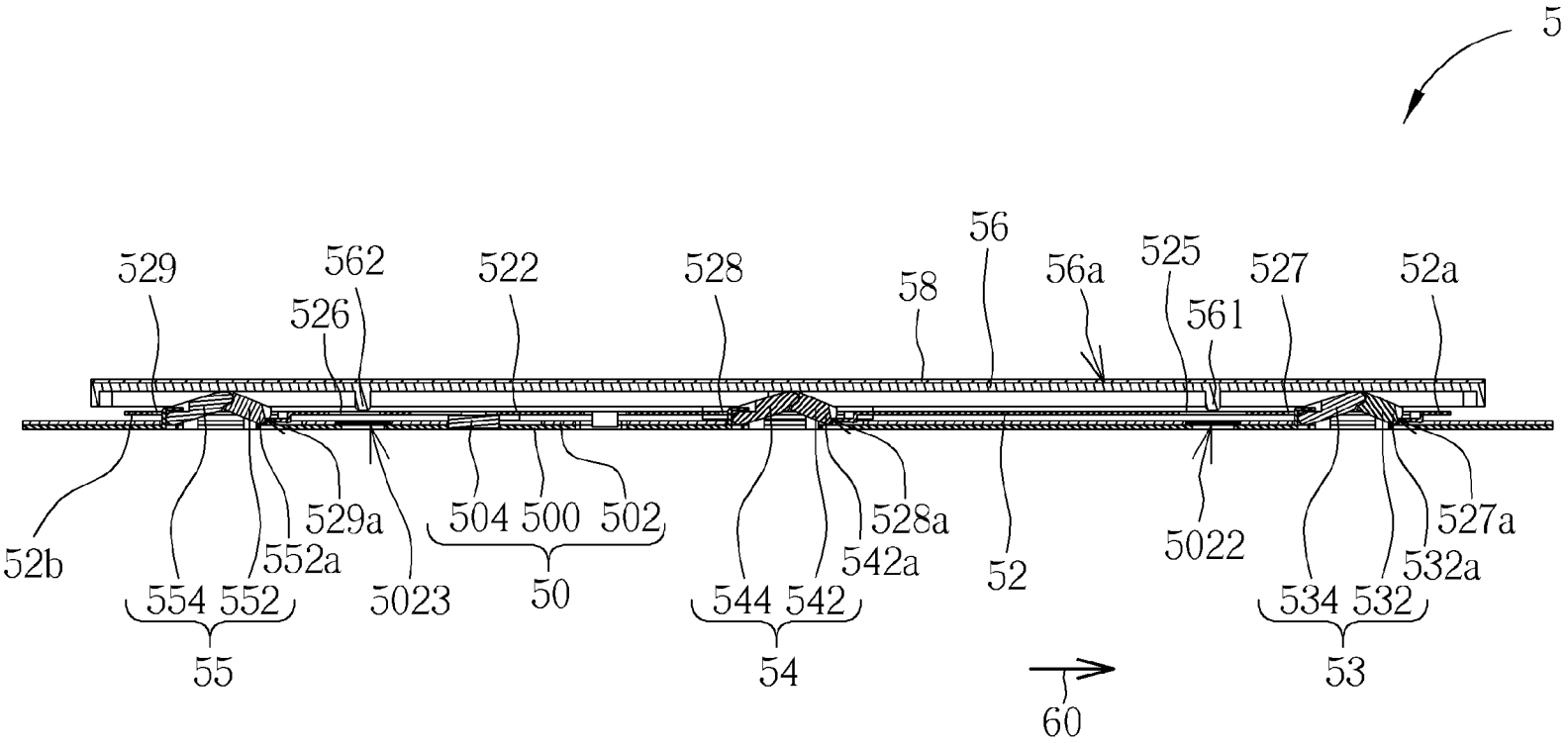
FIG. 17 is a sectional view of the keyswitch structure in FIG. 10 along the line X3-X3.
Figure 18:
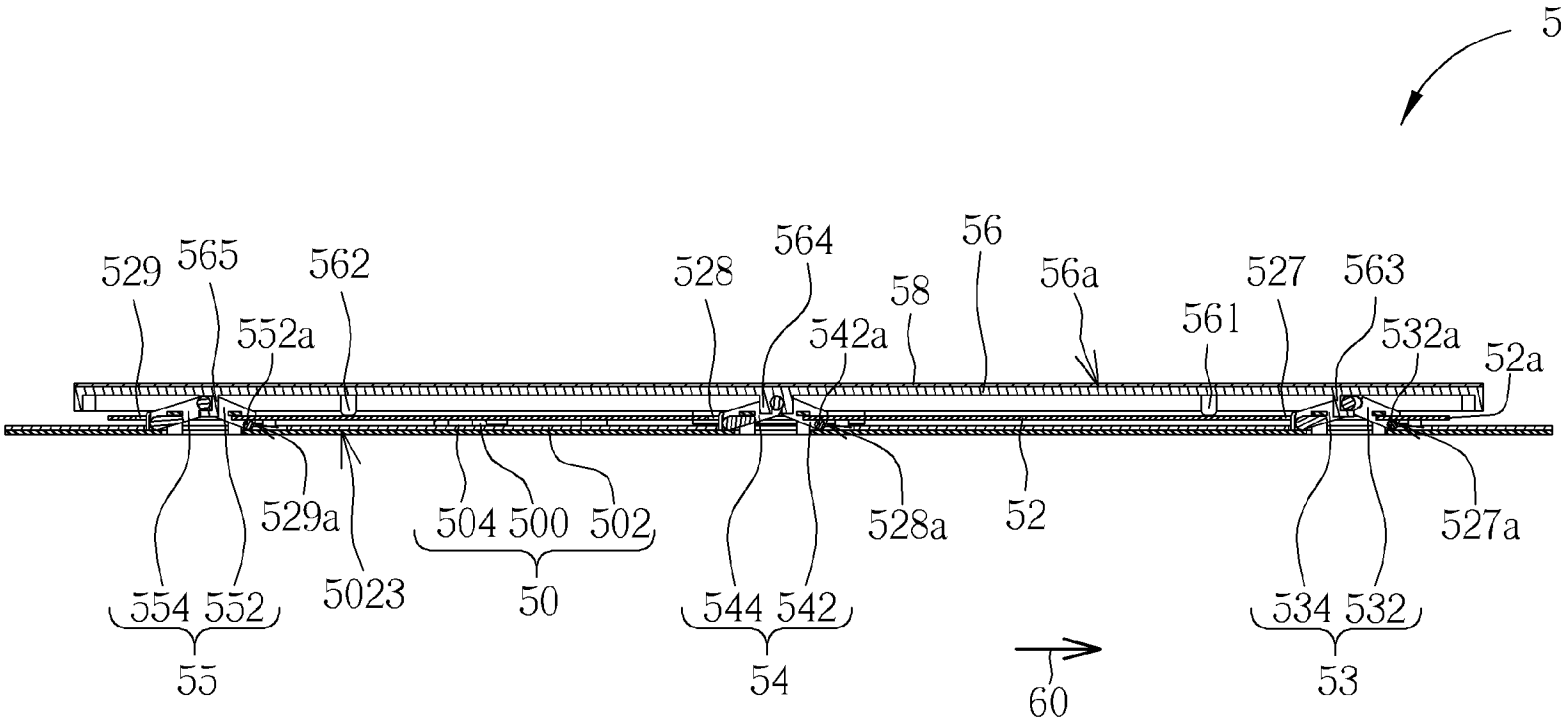
FIG. 18 is another sectional view of the keyswitch structure in FIG. 10 along the line Z3-Z3.

Please refer to FIGS. 14 through 18. FIG. 14 is an exploded view of a keyswitch structure 5 of another embodiment according to the invention. FIG. 15 is a partially exploded view of the keyswitch structure 5. FIG. 16 is a top view of the keyswitch structure 5. FIG. 17 is a sectional view of the keyswitch structure 5 along the line X3-X3 in FIG. 10. FIG. 18 is another sectional view of the keyswitch structure 5 along the line Z3-Z3 in FIG. 10. The keyswitch structure 5 includes a base 50, a link 52, a first lift mechanism 53, a second lift mechanism 54, a third lift mechanism 55, a keycap 56, and a touch pad 58. In FIG. 16, for showing other components clearly, the keycap 56 and the touch pad 58 are shown by their profiles in dashed lines. The keycap 56 is disposed above the base 50. Each of the first lift mechanism 53, the second lift mechanism 54, and the third lift mechanism 55 is connected to and located between the base 50 and the keycap 56, so that the keycap 56 can be pressed to move up and down relative to the base 50 through the first lift mechanism 53, the second lift mechanism 54, and/or the third lift mechanism 55. The touch pad 58 is disposed on a top surface 56*a* of the keycap 56 and has a flat cable 582 for being connected to an electronic apparatus or computer (not shown in the figure), so that the keyswitch structure 5 can also perform a cursor function or other touch functions. In addition, a plurality of numeral symbols are provided on the top surface of the touch pad 58 (for example by printing). The touch area on the touch pad 58 corresponding to each numeral symbol is represented by a rectangle in dashed lines. The user can touch a desired symbol (e.g. numeral symbol 1) and then uses the up and down movement of the keyswitch structure 5 to trigger a switch to input a message to a computer. The link 52 is moveably disposed on the base 50. The link 52 is kinetically connected to the first lift mechanism 53, the second lift mechanism 54, and the third lift mechanism 55 through a restoration mechanism, so that the link 52 can drive the first lift mechanism 53, the second lift mechanism 54, and the third lift mechanism 55 to move.

The keyswitch structure 5 uses the same action mechanism as the keyswitch structure 3. A main difference between the keyswitch structure 5 and the keyswitch structure 3 is that the keyswitch structure 5 uses the three lift mechanisms 53, 54 and 55. In practice, the keyswitch structure 5 can be applied to a wider keyswitch, for example a multiple-width key such as enter key, shift key, space key and so on. For other descriptions of the keyswitch structure 5, please refer to relevant descriptions of the components of the keyswitch structures 1 and 3 presented by the same notations, which will not be described repeatedly.

Briefly, the first lift mechanism 53 includes a first supporting part 532 and a second supporting part 534. The first supporting part 532 and the second supporting part 534 are pivotally connected in a reverse V-shaped configuration. The first supporting part 532 has a first sliding portion 532*a*. The first sliding portion 532*a* is slidably disposed on the base 50. The first lift mechanism 53 and the keycap 56 are connected by a first connection portion 563 of the keycap 56. In the embodiment, the first connection portion 563 is presented in an L-shaped structure so that the first lift mechanism 53 is slidably connected to the keycap 56 through the first connection portion 563. The first sliding portion 532*a* is capable of pushing against a side edge 527*a* of a window 527 of the link 52 so that the purpose of driving the link 52 to move relative to the base 50 is achieved. The second lift mechanism 54 includes a third supporting part 542 and a fourth supporting part 544. The third supporting part 542 and the fourth supporting part 544 are pivotally connected in a reverse V-shaped configuration. The third supporting part 542 has a second sliding portion 542*a*. The second sliding portion 542*a* is slidably disposed on the base 50. The second lift mechanism 54 and the keycap 56 are connected by a second connection portion 564 of the keycap 56. In the embodiment, the second connection portion 564 is presented in a C-shaped structure so that the second lift mechanism 54 is rotatably connected to the keycap 56 through the second connection portion 564. The second sliding portion 542*a* is capable of pushing against a side edge 528*a* of a window 528 of the link 52 so that the purpose of driving the link 52 to move relative to the base 50 is achieved. The third lift mechanism 55 includes a fifth supporting part 552 and a sixth supporting part 554. The fifth supporting part 552 and the sixth supporting part 554 are pivotally connected in a reverse V-shaped configuration. The fifth supporting part 552 has a third sliding portion 552*a*. The third sliding portion 552*a* is slidably disposed on the base 50. The third lift mechanism 55 and the keycap 56 are connected by a third connection portion 565 of the keycap 56. In the embodiment the third connection portion 565 is presented in an L-shaped structure so that the third lift mechanism 55 is slidably connected to the keycap 56 through the third connection portion 565. The third sliding portion 552*a* is capable of pushing against a side edge 529*a* of a window 529 of the link 52 so that the purpose of driving the link 52 to move relative to the base 50 is achieved.

In the embodiment, the first lift mechanism 53, the second lift mechanism 54, and the third lift mechanism 55 are provided in the same structure; however, the invention is not limited thereto. It is added that in the embodiment, the restoration mechanism of the keyswitch structure 5 comprises a first magnetic portion 504, disposed on a plate 500 of the base 50, and a second magnetic portion 522, disposed on the link 52. The restoration force generated by the restoration mechanism is provided by a magnetic force generated by the first magnetic portion 504 and the second magnetic portion 522 therebetween. The first magnetic portion 504 and the second magnetic portion 522 are located between the second lift mechanism 54 and the third lift mechanism 55. Under the magnetic force (i.e. a magnetically attractive force) generated by the first magnetic portion 504 and the second magnetic portion 522, the first sliding portion 532*a*, the second sliding portion 542*a*, and the third sliding portion 552*a* keep touching the side edges 527*a*, 528*a* and 527*a* respectively. In logic, the first sliding portion 532*a* can be regarded as being connected to a first end portion 52*a* of the link 52; the third sliding portion 552*a* can be regarded as being connected to a second end portion 52*b* of the link 52; and the second sliding portion 542*a* can be regarded as being connected to a middle portion of the link 52. In practice, each of the first sliding portion 532*a*, the second sliding portion 542*a*, and the third sliding portion 552*a* also can be connected with the link 52 by another connection structure.

Therefore, when the user presses the keycap 56 (or through the touch pad 58) so that the keycap 56 moves toward the base 50 through the first lift mechanism 54, the second lift mechanism 54, or the third lift mechanism 55, the first sliding portion 532*a*, the second sliding portion 542*a*, and the third sliding portion 552*a* slide on the base 50 in a sliding direction 60 to drive the link 52 to move relative to the base 50; that is, the link 52 moves in the sliding direction 60. Either of two protrusions 561 and 562 of the keycap 56 passes through a corresponding through hole 526 or 527 of the link 52 and triggers a corresponding switch 5022 or 5023 of a membrane 502 of the base 50 so that an function of keyswitch inputting is achieved. During the key press, the magnetic force generated by the first magnetic portion 504 and the second magnetic portion 522 therebetween decreases gradually. Then, when the key press on the keycap 56 by the user is eliminated, the magnetic force urges the link 52 to move in a direction opposite to the sliding direction 60 (i.e. moving reversely) to drive the first sliding portion 532*a*, the second sliding portion 542*a*, and the third sliding portion 552*a* to move in the direction opposite to the sliding direction 60, so that the keycap 56 moves away from the base 50. While the keycap 56 is moving away from the base 50, the magnetic force generated by the first magnetic portion 504 and the second magnetic portion 522 therebetween increases gradually. The magnetic force generated by the first magnetic portion 504 and the second magnetic portion 522 therebetween has an effect of restoring the keycap 56 automatically. Furthermore, the change of the magnetic force (i.e. the change of a force feedback) also can offer the user a distinct feeling of a key press. Especially when the keyswitch structure of the invention is applied to a low-profile keyboard, a problem can be avoided that it is difficult to verify whether a key press is completed or not due to an insufficient movement of the keycap 56.

Figure 19:
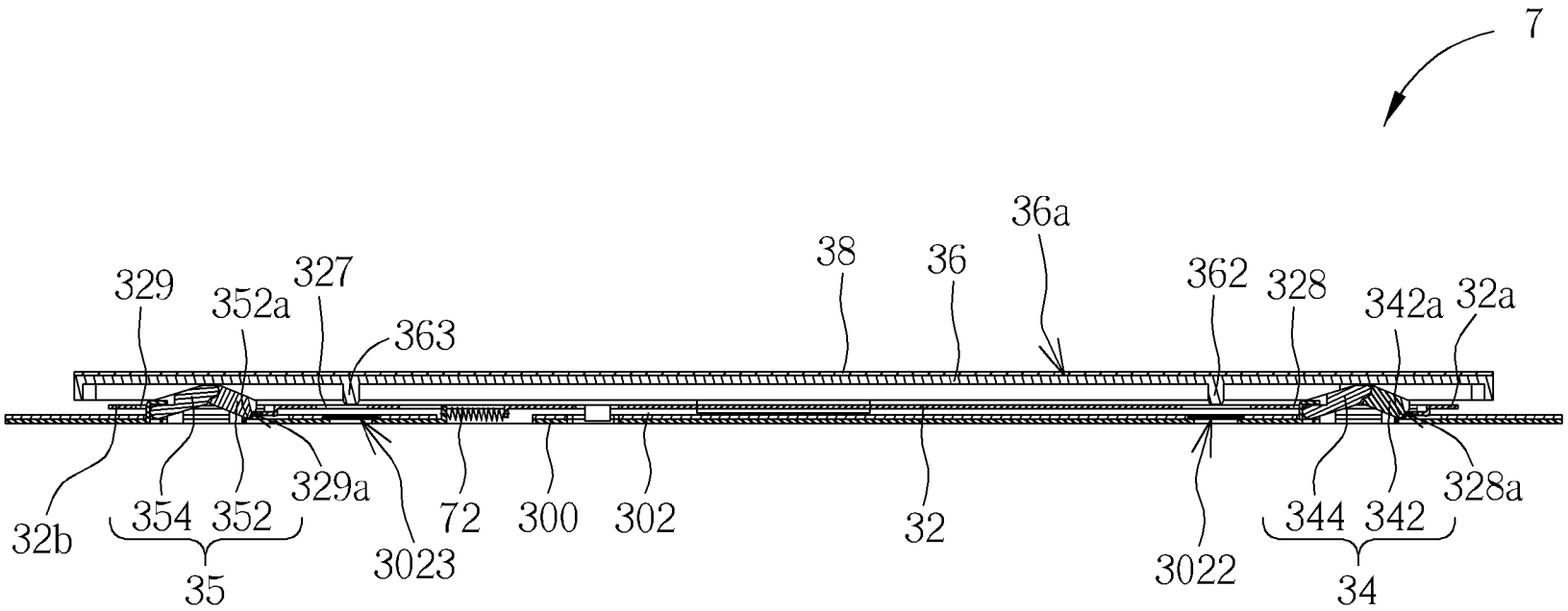
FIG. 19 is a sectional view of the keyswitch structure of another embodiment according to the invention.
Figure 20:
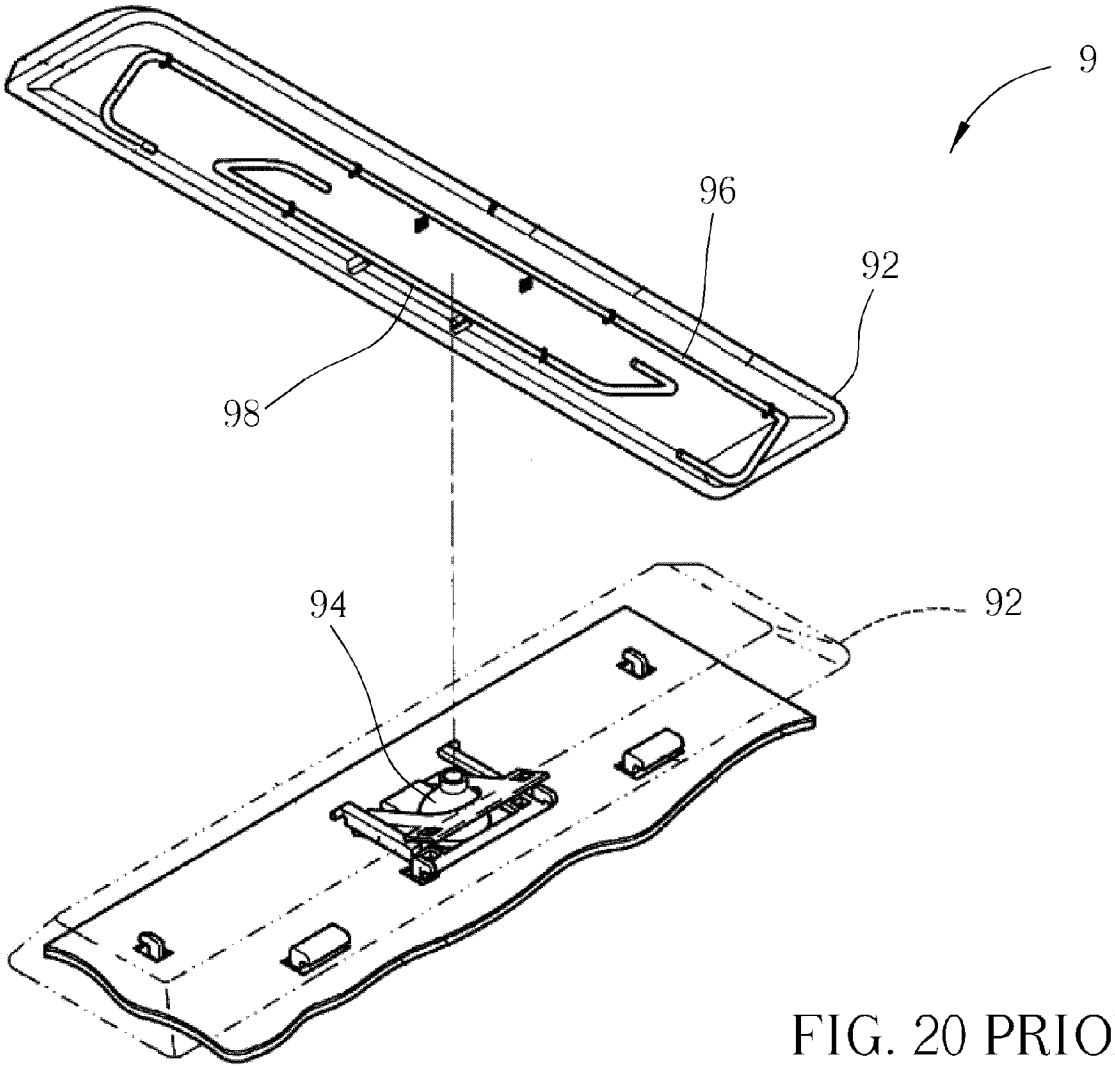
FIG. 20 PRIOR ART
FIG. 20 is a schematic diagram illustrating a conventional keyswitch.

In the above embodiments, the restoration mechanism is realized by magnetic parts; however, the invention is not limited thereto. Please refer to FIG. 19, which is a sectional view of the keyswitch structure 7 of another embodiment according to the invention; the cutting position can refer to the line X2-X2 in FIG. 11. The keyswitch structure 7 and the keyswitch structure 3 use the same action mechanism. The keyswitch structure 7 still uses the component notations used in the keyswitch structure 3. For other descriptions of the keyswitch structure 7, please refer to relevant descriptions of the components of the keyswitch structures 1 and 3 presented by the same notations, which will not be described repeatedly. A main difference between the keyswitch structure 7 and the keyswitch structure 3 is that the restoration mechanism of the keyswitch structure 7 is realized by an elastic part 72 (for example a spring). An end of the elastic part 72 is connected to the link 32; the other end of the elastic part 72 is connected to the plate 300. The elastic part 72 can elastically deform to generate a restoration force. Therefore, the restoration mechanism provided by the elastic part 72 also has an effect of restoring the keycap 36 automatically.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch structure comprising:

a base comprising a first magnetic portion;

a keycap disposed above the base;

a first lift mechanism connected to and between the base and the keycap, the first lift mechanism comprising a first supporting part and a second supporting part, the first lift mechanism and the keycap being connected by a first connection portion, the first supporting part having a first sliding portion slidably disposed on the base, the keycap being capable of moving up and down relative to the base through the first lift mechanism; and a link moveably disposed on the base, the link having a second magnetic portion, the second magnetic portion and the first magnetic portion generating a magnetic force therebetween;

wherein when the keycap is pressed by a user so that the keycap moves toward the base through the first lift mechanism, the first sliding portion slides on the base in a sliding direction and drives the link to move relative to the base, and when the pressing on the keycap by the user is eliminated, the magnetic force urges the link to move to drive the first sliding portion to slide in a direction opposite to the sliding direction so that the keycap moves away from the base.

2. The keyswitch structure of claim 1 wherein the first magnetic portion is a magnet, and the link is a magnetic metal plate.

3. The keyswitch structure of claim 1 wherein the link has a slot extending parallel to the sliding direction, the first magnetic portion is located in the slot, and the second magnetic portion is located at a side edge of the slot opposite to the sliding direction.

4. The keyswitch structure of claim 1 wherein the first supporting part and the second supporting part are connected in a reverse V-shaped configuration.

5. The keyswitch structure of claim 1 wherein the base comprises a switch, the keycap has a protrusion, the protrusion is adjacent to the first lift mechanism and extends from a bottom surface of the keycap toward the base corresponding to the switch, and when the keycap moves toward the base through the first lift mechanism, the protrusion triggers the switch.

6. The keyswitch structure of claim 1 further comprising a touch pad disposed on a top surface of the keycap.

7. The keyswitch structure of claim 1 wherein the base comprises a constraining mechanism for constraining a rotational angle of the second supporting part relative to the base.

8. The keyswitch structure of claim 1 further comprising a second lift mechanism connected to and between the base and the keycap, the second lift mechanism comprising a third supporting part and a fourth supporting part, the second lift mechanism and the keycap being connected by a second connection portion, the third supporting part having a second sliding portion slidably disposed on the base, the keycap being capable of moving up and down relative to the base through the first lift mechanism or the second lift mechanism, wherein when the keycap is pressed by the user so that the keycap moves toward the base through the first lift mechanism or the second lift mechanism, the first sliding portion and the second sliding portion slide on the base in the sliding direction and drive the link to move relative to the base, and when the pressing on the keycap by the user is eliminated, the magnetic force urges the link to move to drive the first sliding portion and the second sliding portion to slide in the direction opposite to the sliding direction so that the keycap moves away from the base.

9. The keyswitch structure of claim 8 wherein the first lift mechanism and the second lift mechanism are rotatably and slidably connected to the keycap through the first connection portion and the second connection portion respectively.

10. The keyswitch structure of claim 8 wherein the first magnetic portion and the second magnetic portion are located between the first lift mechanism and the second lift mechanism.

11. The keyswitch structure of claim 8 further comprising a third lift mechanism connected to and between the base and the keycap, the third lift mechanism comprising a fifth supporting part and a sixth supporting part, the third lift mechanism and the keycap being connected by a third connection portion, the fifth supporting part having a third sliding portion slidably disposed on the base, the keycap being capable of moving up and down relative to the base through the first lift mechanism, the second lift mechanism, or the third lift mechanism, wherein when the keycap is pressed by the user so that the keycap moves toward the base through the first lift mechanism, the second lift mechanism, or the third lift mechanism, the first sliding portion, the second sliding portion, and the third sliding portion slide on the base in the sliding direction and drive the link to move relative to the base, and when the pressing on the keycap by the user is eliminated, the magnetic force urges the link to move to drive the first sliding portion, the second sliding portion, and the third sliding portion to slide in the direction opposite to the sliding direction so that the keycap moves away from the base.

12. The keyswitch structure of claim 11 wherein the first lift mechanism and the third lift mechanism are slidably connected to the keycap through the first connection portion and the third connection portion respectively, and the second lift mechanism is rotatably connected to the keycap through the second connection portion.

13. A keyswitch structure comprising:

a base comprising a first magnetic portion;

a keycap disposed above the base;

a first lift mechanism connected to and between the base and the keycap, the first lift mechanism comprising a first supporting part, the first supporting part having a first sliding portion slidably disposed on the base;

a link having a first end portion and a second end portion, the first end portion being connected to the first sliding portion;

a second lift mechanism connected to and between the base and the keycap, the second lift mechanism comprising a third supporting part, the third supporting part having a second sliding portion slidably disposed on the base and connected to the second end portion, the keycap being capable of moving up and down relative to the base through the first lift mechanism or the second lift mechanism; and a restoration mechanism for generating a restoration force, the restoration mechanism being disposed on the link and the base;

wherein when the keycap moves toward the base through the first lift mechanism or the second lift mechanism, the first sliding portion and the second sliding portion slide on the base in a sliding direction and drive the link to move relative to the base, and the restoration force urges the link to move to drive the first sliding portion and the second sliding portion to slide in a direction opposite to the sliding direction so that the keycap moves away from the base.

14. The keyswitch structure of claim 13 wherein the restoration mechanism comprises an elastic part connected to the link and the base, and the elastic part is capable of elastically deforming to generate the restoration force.

15. The keyswitch structure of claim 13 wherein the first lift mechanism comprises a second supporting part, the first supporting part and the second supporting part are connected in a reverse V-shaped configuration, and the first lift mechanism is connected to and between the base and the keycap through the first supporting part and the second supporting part.

16. The keyswitch structure of claim 13 wherein the base comprises a switch, the keycap has a protrusion, the protrusion is adjacent to the first lift mechanism and extends from a bottom surface of the keycap toward the base corresponding to the switch, and when the keycap moves toward the base through the first lift mechanism, the protrusion triggers the switch.

17. The keyswitch structure of claim 13 further comprising a touch pad disposed on a top surface of the keycap.

18. The keyswitch structure of claim 13 wherein the restoration mechanism is disposed between the first lift mechanism and the second lift mechanism.

19. The keyswitch structure of claim 18 further comprising a third lift mechanism connected to and between the base and the keycap, the third lift mechanism comprising a fifth supporting part and a sixth supporting part, the third lift mechanism and the keycap being connected by a third connection portion, the fifth supporting part having a third sliding portion slidably disposed on the base, the keycap being capable of moving up and down relative to the base through the first lift mechanism, the second lift mechanism, or the third lift mechanism, wherein when the keycap is pressed by a user so that the keycap moves toward the base through the first lift mechanism, the second lift mechanism, or the third lift mechanism, the first sliding portion, the second sliding portion, and the third sliding portion slide on the base in the sliding direction and drive the link to move relative to the base, and when the pressing on the keycap by the user is eliminated, the restoration force urges the link to move to drive the first sliding portion, the second sliding portion, and the third sliding portion to slide in the direction opposite to the sliding direction so that the keycap moves away from the base.

20. The keyswitch structure of claim 13 wherein the restoration mechanism comprises a first magnetic portion and a second magnetic portion, the first magnetic portion is disposed on the base, the second magnetic portion is disposed on the link, the second magnetic portion and the first magnetic portion generate a magnetic force therebetween as the restoration force.

21. The keyswitch structure of claim 20 wherein the first magnetic portion is a magnet and the link is a magnetic metal plate.

22. The keyswitch structure of claim 20 wherein the link has a slot extending parallel to the sliding direction, the first magnetic portion is located in the slot, and the second magnetic portion is located at a side edge of the slot opposite to the sliding direction.

* * * * *